US007242746B2

(12) United States Patent
Michaelsen et al.

(10) Patent No.: US 7,242,746 B2
(45) Date of Patent: Jul. 10, 2007

(54) METHOD FOR MANUFACTURING A REFLECTOR FOR X-RAY RADIATION

(75) Inventors: Carsten Michaelsen, Geesthacht (DE); Michael Dahms, Geesthacht (DE)

(73) Assignee: Incoatec GmbH, Geesthacht (DE)

( * ) Notice: Subject to any disclaimer, the term of this patent is extended or adjusted under 35 U.S.C. 154(b) by 0 days.

(21) Appl. No.: 11/290,545

(22) Filed: Dec. 1, 2005

(65) Prior Publication Data

US 2006/0133569 A1 Jun. 22, 2006

Related U.S. Application Data

(63) Continuation of application No. 10/695,504, filed on Oct. 29, 2003, now abandoned.

(30) Foreign Application Priority Data

Nov. 20, 2002 (DE) ..... 102 54 026

(51) Int. Cl.
*G21K 1/06* (2006.01)

(52) U.S. Cl. ..... 378/84; 378/82; 378/145; 250/505.1

(58) Field of Classification Search ..... 378/34, 378/82, 84, 85, 119, 145; 250/505.1
See application file for complete search history.

(56) References Cited

U.S. PATENT DOCUMENTS 5,646,976 A 7/1997 Gutman
5,742,658 A * 4/1998 Tiffin et al. ..... 378/44
6,014,423 A * 1/2000 Gutman et al. ..... 378/85
6,226,349 B1 * 5/2001 Schuster et al. ..... 378/84
6,249,566 B1 * 6/2001 Hayashi et al. ..... 378/85
6,278,764 B1 * 8/2001 Barbee et al. ..... 378/84
6,285,743 B1 * 9/2001 Kondo et al. ..... 378/119
6,317,483 B1 * 11/2001 Chen ..... 378/84
6,339,634 B1 * 1/2002 Kandaka et al. ..... 378/119
6,389,100 B1 * 5/2002 Verman et al. ..... 378/84
6,421,417 B1 * 7/2002 Jiang et al. ..... 378/84
6,504,902 B2 * 1/2003 Iwasaki et al. ..... 378/84
6,529,578 B1 * 3/2003 Taguchi et al. ..... 378/84
6,577,704 B1 * 6/2003 Holz ..... 378/44
6,590,959 B2 * 7/2003 Kandaka et al. ..... 378/119
6,606,371 B2 * 8/2003 Antonell et al. ..... 378/84
6,625,251 B2 * 9/2003 Takenaka et al. ..... 378/84
6,823,042 B2 * 11/2004 Hayashi et al. ..... 378/84
6,829,327 B1 * 12/2004 Chen ..... 378/44

OTHER PUBLICATIONS

M. Schuster et al., "Laterally Graded Multilayer Optics for X-Ray Analysis", SPIE 3767, 183-198 (1999).*

* cited by examiner

*Primary Examiner*—Allen C. Ho
(74) *Attorney, Agent, or Firm*—Paul Vincent

(57) ABSTRACT

A method for manufacturing a reflector (5) for X-ray radiation (2, 3, 10, 11) which is curved in a non-circular arc shape, along a first cross-section (13) in a plane (XZ) which contains a x-direction, wherein the reflector (5) is also curved along a second cross-section (14) in a plane (YZ) which is perpendicular to the x-direction, is characterized in that the reflector (5) has a curvature along the second cross-section (14) which also differs from the shape of a circular arc. This makes the design of X-ray mirrors and the beam profile of reflected X-ray radiation more flexible, facilitates production of X-ray mirrors and at the same time provides high reflection capacity and good focusing properties for X-ray mirrors.

21 Claims, 19 Drawing Sheets

METHOD FOR MANUFACTURING A REFLECTOR FOR X-RAY RADIATION

This application is a continuation of U.S. application Ser. No. 10/695,504 filed on Oct. 29, 2003 now abandoned and also claims Paris Convention priority of DE 102 54 026.8 filed Nov. 20, 2002 the complete disclosures of which are hereby incorporated by reference.

BACKGROUND OF THE INVENTION

The invention concerns a reflector for X-ray radiation which is curved in a non-circular arc shape along a first cross-section in a plane containing an x-direction (tangential curvature), wherein the reflector is also curved along a second cross-section in a plane perpendicular to the x-direction (sagittal curvature).

An X-ray mirror of this type is disclosed e.g. in DE 44 07 278 A1.

X-ray radiation is electromagnetic radiation as is visible light. Due to the higher energy on the order of keV, the interaction between X-ray radiation and matter is significantly different than with visible light. Considerable difficulties were found in providing effective optical structural elements such as mirrors or lenses for X-ray radiation. The structural elements realized up to now are based mainly on Bragg diffraction and total reflection, both under grazing incidence.

In a flat embodiment, an X-ray mirror on the basis of the Bragg diffraction can only reflect a very small portion of the incident divergent X-ray radiation, since the Bragg condition requires relatively accurate angles of incidence. To solve this problem, curved mirror surfaces and also a locally variable planar separation were suggested. The curvature of the mirror surface and the planar separation may thereby vary along a first direction x which corresponds approximately to the main propagation direction of the X-ray radiation (under grazing incidence). For normal dimensions of X-ray analysis devices, the local radius of curvature is on the order of meters and usually has a parabolic or elliptical shape. It is technically relatively easy to produce. To realize a variable planar separation, a multi-layer mirror design has been used. This type of X-ray mirror is referred to as a "Goebel Mirror" (DE 44 07 278 A1).

The reflectivity of the Goebel mirror is limited in that the divergence of the beam perpendicular to the x-direction in the mirror plane cannot be satisfactorily taken into consideration. Two-dimensional focusing is feasible through a rotationally symmetrical design i.e. a second circular arc-shaped mirror curvature in the plane perpendicular to the x-direction. For typical dimensions of X-ray analysis devices, the mirror must have radii of curvature perpendicular to the x-direction in the millimeter range. It has not been previously possible to produce such a strongly curved X-ray mirror with sufficient accuracy, since sufficiently precise reduction in the surface roughness and waviness of such a strongly curved mirror is difficult. Moreover, it has not been possible up to now to prevent layer thickness errors for multi-layer mirrors in the region of large radii of curvature (i.e. at the mirror edge) using conventional coating techniques (sputtering, molecular beam epitaxy etc.), with a reasonable degree of effort. These coating errors reduce the reflectivity of the X-ray mirrors for the desired X-ray wavelength and introduce scattered rays of other wavelengths.

To still obtain two-dimensional focusing, two one-dimensionally focusing Goebel mirrors, which are rotated relative to each other through approximately 90°, must be used in series. This causes considerable intensity loss.

Another disadvantage of rotationally symmetrical Goebel mirrors is the circular annular beam profile of the reflected X-ray radiation outside of the focus. Either the sample or the detector is usually in the focus and therefore either the detector or the sample must be disposed in the region of the annular beam profile. This reduces the intensity, and the optical path of such an X-ray analysis device lacks flexibility due to the annular beam profile.

Rotationally symmetrical total reflection mirrors with two-dimensional focusing are also known. Due to the reduced light collecting capacity, the very small maximum angle of incidence, the associated adjustment difficulties, and the lack of monochromatization, total reflection mirrors are no practical alternative.

In contrast thereto, it is the object of the present invention to make the design of X-ray mirrors and the beam shape of reflected X-ray radiation more flexible, to facilitate production of X-ray mirrors with high efficiency (i.e. high reflection capacity and good focusing properties).

SUMMARY OF THE INVENTION

This object is achieved in a surprisingly simple but effective fashion by a method for manufacturing a reflector for X-ray radiation (X-ray mirror) of the above-presented type which is characterized in that the reflector has a curvature along the second cross-section which is also not circular arc-shaped.

The curvature along the second cross-section (sagittal curvature) is particularly critical for the production of two-dimensional focusing mirrors. In accordance with the invention, this second curvature is not circular arc-shaped. In particular, deviations, which reduce the curvature of the reflector along the second cross-section and in particular in the edge region of the reflector, are of particular importance. The polishing processes for reducing the roughness or waviness of the reflector surface can be greatly facilitated.

A deviation from the rotationally symmetrical shape also offers new design possibilities for the beam shape of the reflected X-rays outside of the focus. The circular annular shape outside of the focus can be eliminated and appropriate design of the curvature of the inventive reflector along the second cross-section can be used to adjust the beam shape to the requirements of a particular experiment. Possible alternative beam shapes include an elliptical, annular shape and a lens-type shape. The beam shape can, in particular, be adjusted to the shape of a sample to be examined, to an X-ray detector, or an entrance slit thereof.

The deviation from the curvature along the second cross-section permits compensation of coating errors in multi-layer mirrors, without reducing the reflectivity of the X-ray mirror (see below).

In an advantageous embodiment of the inventive reflector, the curvature of the reflector along the second cross-section adjusts the focusing properties of the reflector, in particular in the plane perpendicular to the x-direction. The curvature of the reflector along the second cross-section determines the direction of the outgoing X-rays, which, upon incidence initially diverge in the reflector plane perpendicular to the x-direction. The focusing effect of the curvature along the second cross-section can preferably be selected such that the focus of both curvatures of the reflector coincide e.g. at the detector or at infinity (parallel beam).

One embodiment of the inventive reflector is particularly advantageous wherein the reflector focuses or renders parallel in two dimensions. This produces a high intensity of the outgoing X-rays since only one loss-causing reflection on the inventive reflector is required for two-dimensional focusing or parallelization of the X-rays.

In a further advantageous embodiment, the reflector is curved parabolically, hyperbolically or elliptically along the first cross-section (tangential curvature). The parabolic shape is the basic shape of the Goebel mirror and permits parallelization of the outgoing X-rays, which exhibit a beam divergence when incident on the reflector across the mirror surface in the x-direction. An elliptical shape permits focusing of the initially divergent beam to a specific focal spot.

The preferred embodiment of the inventive reflector is characterized in that the reflector has a periodically repeating sequence of layers of materials A, B, . . . with different refractive indices, wherein the sum $d=d_A+d_B+ \ldots$ of the thicknesses $d_A$, $d_B$, . . . of sequential layers of materials A, B, . . . changes continuously along the x-direction, in particular, monotonically. This embodiment corresponds to a Goebel mirror whose curvature along the second cross-section is not circular arc-shaped. Up to now it has not been technically possible to produce Goebel mirrors with rotationally symmetrical second curvature of satisfactory quality. The above-mentioned embodiment is far easier to produce than a rotationally symmetrical Goebel mirror and has comparable X-ray optical properties. The change in the angle of incidence on the multi-layer across the length of the X-ray mirror from the front to the back (in the x-direction) is compensated for with respect to the Bragg condition through adjusting the layer separation (planar separation) to ensure good reflectivity for the X-ray radiation of a given wavelength over the entire length of the X-ray mirror. Focusing of the beam divergence perpendicular to the x-direction in the mirror plane is adjusted via the non-circular arc shaped curvature along the second cross-section, a shape which generally produces incomplete focusing. This may be desired for certain applications and is therefore explicitly part of the present invention.

A further particularly advantageous development of this embodiment is characterized in that the sum d changes along the second cross-section, in particular by more than 2%. The change in the sum d along the second cross-section is an almost unavoidable error when coating strongly curved surfaces. The curvature is particularly strong in the edge region of the reflector and for this reason, in conventional coating methods, the layer thickness there is smaller than at non-curved, flat locations. When the layer thickness changes, the angle of incidence of the radiation must be adjusted to ensure further fulfillment of the Bragg equation and thereby ensure sufficient reflectivity for a given wavelength. The angle of incidence is a function of the local curvature of the reflector. When the curvature dependence of the coating thickness is known (e.g. by model calculation described below, or experimentally) the actual reflection and focusing behavior of the finished multi-layer reflector can be determined and adjusted through precise previous setting of the curvature of the mirror.

In one particularly advantageous embodiment of this further development, the curvature of the reflector along the second cross-section effects focusing and reflectivity properties of a reflector having changes in the sum d along the second cross-section which correspond to those of a reflector having circular curvature along its second cross-section and a constant sum d. This design realizes an X-ray optical component whose properties correspond to a rotationally symmetrical Goebel mirror. Realization of a functioning rotationally symmetrical Goebel mirror has not been possible up to now. Production of this inventive embodiment is easier since the curvature along the second cross-section is reduced and the unavoidable layer thickness errors can be accepted.

In another advantageous embodiment, the reflector has an elliptical curvature with different semi-axis lengths or a parabolic curvature along the second cross-section. The elliptical structure is particularly suited for focusing the divergence of radiation perpendicular to the x-axis in the mirror plane. The parabolic shape promotes formation of a parallel beam.

In an advantageous embodiment of the inventive reflector, the reflector has a reflecting surface of a width of more than 2 mm, in particular at least 4 mm (measured perpendicular to the x direction). In conventional rotationally symmetrical Goebel mirrors, the reflectivity decreases towards the edge for a given wavelength. In particular, for conventional dimensions of an X-ray analysis device, reflecting widths are limited to less than 2 mm. The inventive reflector has a high reflectivity for much larger widths. This increases the reflected intensity in accordance with the invention, to first approximation, in proportion to the reflecting surface.

The present invention also concerns an X-ray analysis device with an X-ray source, a sample to be analyzed, an X-ray detector, beam-forming and/or beam-delimiting means and the inventive reflector described above. The inventive reflector is particularly advantageous when used in such an X-ray analysis device. In addition to an X-ray tube, the X-ray source may comprise a separate monochromator. The sample may be disposed on a goniometer. The detector may be designed to resolve energy or be integrally event counting.

In a preferred embodiment of the inventive X-ray analysis device, the X-ray radiation impinges on the reflector at an angle of less than 5° with respect to the x-direction. Bragg diffraction is particularly effective under these circumstances, since, for conventional X-ray radiation in the region of some keV (e.g. Cu—K$\alpha$), the associated layer thickness is technically easy to realize.

In another advantageous embodiment, the curvature of the reflector along the second cross-section is designed such that the reflectivity of the reflector is maximum for the wavelength of the radiation generated by the X-ray source. This leads to high reflecting intensities and therefore shorter measuring times in the X-ray analysis device. In particular, different reflectors may be exchanged for use with different X-ray wavelengths.

One embodiment is particularly advantageous wherein the reflector focuses X-ray radiation incident thereon to a point-like region (focal spot), in particular onto the sample or the X-ray detector. These are the most frequent applications for an optical path, since the counting rate on the detector is thereby maximized.

One embodiment of an inventive X-ray analysis device is also advantageous with which the reflector generates an X-ray beam from the incident X-ray radiation having a desired beam divergence, in particular a parallel beam. Parallel beams can illuminate samples with high uniformity and a similar beam profile can be projected on both the sample and the detector.

Further advantages of the invention can be extracted from the description and the drawing. The features mentioned above and below can be used in accordance with the invention either individually or collectively in arbitrary combination. The embodiments shown and described are not to be understood as exhaustive enumeration, rather have exemplary character for describing the invention.

The invention is shown in the drawing and is explained in more detail with reference to embodiments.

DESCRIPTION OF THE PREFERRED EMBODIMENT

Figure 1A:
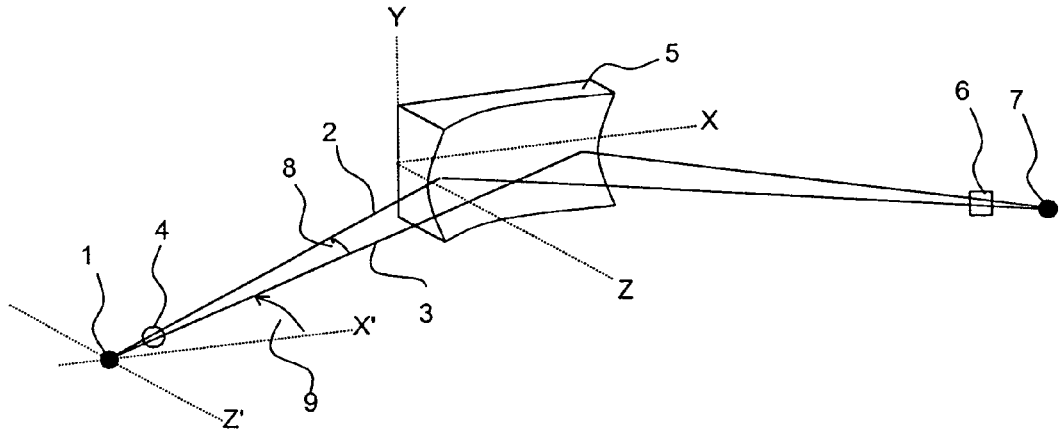
FIG. 1*a* shows an inventive X-ray analysis device with schematic representation of a beam divergence, which sweeps over an inventive reflector in the x-direction.

FIG. 1 schematically shows the structure of an inventive X-ray analysis device. The X-ray source 1 emits X-ray radiation. FIG. 1*a* shows two beams 2 and 3 of this X-ray radiation. Both beams 2, 3 pass a collimator 4 and are incident on the reflecting surface of the inventive reflector 5. An orthogonal coordinate system X, Y, Z is associated with the reflector 5. The reflector is a gradient multi-layer mirror. The reflecting surface in the z-direction is formed by a periodic sequence of at least two layers of materials A, B with different refractive indices for the incident X-ray radiation. The respective layers extend approximately in neighboring XY planes. The reflecting surface of the reflector 5 is curved in two dimensions (see FIGS. 2*a* and 2*b*). In accordance with the invention, neither of the two curvatures has the shape of a circular arc.

The beams 2, 3 are reflected on the reflector 5, penetrate through the sample 6 and are registered in the X-ray detector 7.

The beams 2, 3 have a divergence 8 in the XZ plane of typically 0.2 to 2°. The angle of incidence 9 of the two beams 2, 3 is thereby approximately 0.5 to 2.5° with respect to the X direction or the X' direction (the angle of incidence 9 is exaggerated in FIG. 1*a* and also in FIG. 1*b* for reasons of clarity). The X-direction is the main direction of extension of the reflector 5. Apart from the angle of incidence 9, the direction of incidence of the X-ray radiation on the reflector 5 coincides with the X-direction.

Figure 2A:
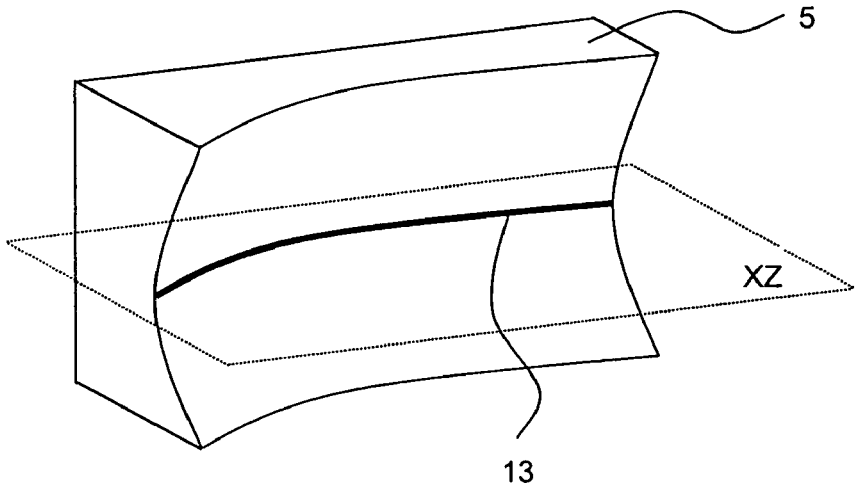
FIG. 2*a* shows the inventive reflector of FIG. 1*a* and a first cross-section in a plane, which contains the x-direction.

The divergence 8 of impinging X-ray radiation in the XZ plane is focused through the curvature of the reflector along its first cross-section (tangential curvature) in the XZ plane, i.e. the plane containing the x-direction (see FIG. 2*a*). In FIG. 1*a*, the curvature of the reflector along the first cross-section is parabolic.

Figure 1B:
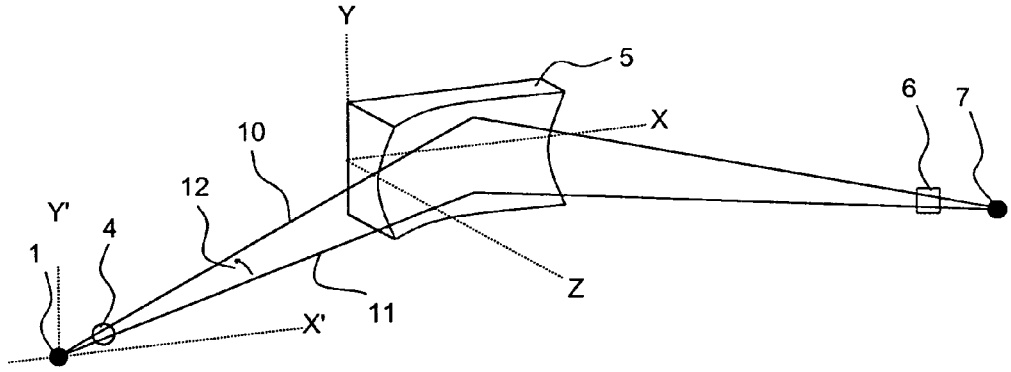
FIG. 1*b* shows the X-ray analysis device of FIG. 1*a* with schematic representation of a beam divergence, which sweeps over the reflector in the mirror plane perpendicular to the x-direction.

FIG. 1*b* shows the same X-ray analysis device as FIG. 1*a*, however, comprising two other beams 10 and 11. Both beams have a divergence 12 in the YZ plane. The order of magnitude of this divergence 12 is approximately 1–2°. The beams 10, 11 are reflected at the surface of the reflector 5, penetrate through the sample 6 and are registered in the detector 7.

Figure 2B:
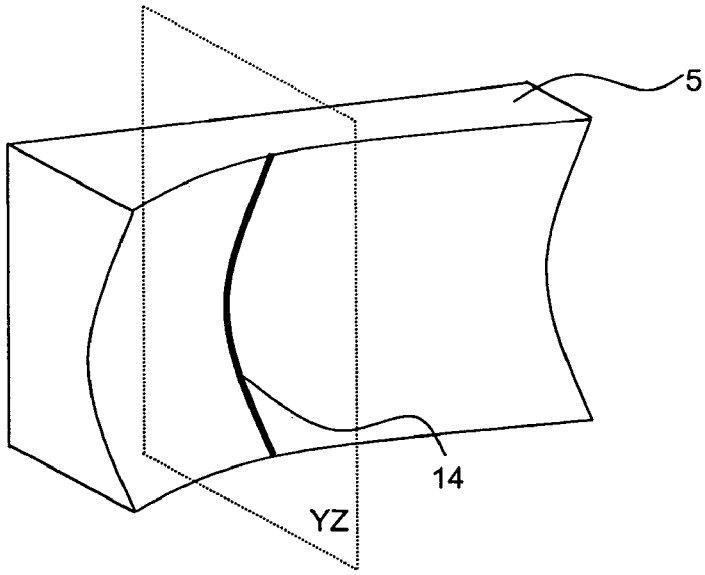
FIG. 2*b* shows the inventive reflector of FIG. 1*a* and a second cross-section in a plane perpendicular to the x-direction.

The divergence 12 of the incident X-ray radiation in the YZ plane is focused by the curvature of the reflector along a second cross-section (sagittal curvature) in the YZ plane, i.e. perpendicular to the x-direction (see FIG. 2*b*). In contrast to the conventional Goebel mirror, the inventive reflector 5 has a curvature, which is not circular arc shaped, but approximately elliptical.

The curvature of the reflector 5 is shown in FIGS. 2*a* and 2*b*. Both figures show the reflector 5 of FIG. 1*a/b* in an enlarged scale. The intersection line 13 of the reflecting surface of the reflector 5 and XZ plane (which contains the X direction) illustrates the curvature of the reflector in a first dimension. In FIG. 2*a*, this curvature is parabolic. The first curvature represents the curvature of the reflector along the first cross-section.

The intersection line 14 of the reflecting surface of the reflector 5 in the YZ plane illustrates the curvature of the reflector in a second dimension. In FIG. 2*b*, this curvature is elliptical. This second curvature represents the curvature of the reflector along the second cross-section and, in accordance with the invention, does not have the shape of a circular arc. In this embodiment, the reflector surface is mirror-symmetrical relative to a central XZ plane. This is generally advantageous for the invention to obtain uniformly illuminating reflected X-rays.

The inventive device is explained in detail below for X-rays incident on two-dimensionally curved X-ray reflectors, in particular multi-layer X-ray reflectors with a shape other than rotationally symmetrical.

X-ray radiation reflectors having a multi-layer structure have been used in different X-ray analysis instruments for some time. These multi-layers typically consist of some ten to some hundred individual alternating layers of two or more materials, with individual layer thickness of typically 1–20 nm. These multi-layers deflect and monochromatize incident X-rays through diffraction in correspondence with the Bragg equation. The reflectivity of these multi-layers may be very high for X-rays. Reflectivities of up to 90% were theoretically predicted and also obtained in experiments through continuous improvements in manufacturing coating techniques. For actual spatially extended X-ray sources (in contrast to theoretical, ideal point sources) the reflectivities are reduced to typically 30–70%, depending on the source size. For use in the region of hard X-ray radiation (wavelengths typically 0.05–0.25 nm), the deflection angles are typically in the region between 0.5–2.5 degrees: within the range of grazing incidence.

Substantial improvements in such X-ray reflectors were obtained e.g. in U.S. Pat. No. 6,226,349 and in M. Schuster, H. Göbel, L. Brügemann, D. Bahr, F. Burgäzy, C. Michaelsen, M. Störmer, P. Ricardo, R. Dietsch, T. Holz and H. Mai "Laterally graded multi-layer optics for X-ray analysis", Proc. SPIE 3767, pp. 183–198, 1999 by curving the reflectors in one dimension (parabolically, elliptically, etc.). The requirements for the shape accuracy of these reflectors are high and are in a region of considerably less than 1 micrometer. To obtain high reflectivity for such reflectors at all locations of the reflector, the multi-layer coatings must vary in a highly defined manner over the surface of the reflector according to the conditions e.g. disclosed in U.S. Pat. No. 6,226,349 and the above cited Schuster publication. The requirements for precision of the coating of such reflectors are quite high and are typically 1–3% of the individual layer thicknesses. These tolerances result from the widths of the multi-layer Bragg reflections, which are typically in the region of 1–3% of the Bragg angle. This results in tolerance requirements for the coating, which are typically in the region of some tens of picometers. Despite these extreme requirements, such reflectors have been recently produced using different methods and have been commercially available for several years.

Since these reflectors are operated with small angles of incidence, the shape is substantially flat (in the range of some ten micrometers) and the radii of curvature are typically a few meters. Macroscopically seen, the reflectors are substantially flat. Due to the curvature of the reflectors, coating of these macroscopically flat reflectors produces no additional problems compared to flat reflectors and the coating of these reflectors is also substantially flat.

Two-dimensionally curved rotationally symmetrical reflectors (rotational ellipsoid, rotationally paraboloid, etc. or segments of these shapes) also coated with multi-layers have been suggested many times for X-rays, e.g. U.S. Pat. No. 4,525,853, U.S. Pat. No. 4,951,304, U.S. Pat. No. 5,222,113. However, they were never realized. Reasons therefor are the enormous technical problems with coating (tangentially varying according to U.S. Pat. No. 6,226,349 and at the same time extremely homogeneous (1–3%) in a transverse direction in which the optics is now also curved). The principal reason therefor is that these reflectors must be substantially flat in one direction (radii of curvature in the meter range), but strongly curved perpendicular thereto (sagittal) with typical curvature radii of only a few millimeters, since the reflectors are operated at small angles of incidence. In addition to the need for extremely precise coating in the tangential direction (specified in U.S. Pat. No. 6,226,349), the considerable angles of inclination in the transverse direction lead to coating errors, since the reflectors are no longer flat but macroscopically curved. Since the layer thicknesses of typical coating methods change with the angle of inclination with respect to the coating source, the additional requirement that the layer thickness be homogeneous in a transverse direction (in the range of a few tens of picometers) is an additional technical challenge. The required coating has not been obtained up to now.

For this reason, two-dimensionally collimating or focusing multi-layer X-ray reflectors have been realized up to now only according to U.S. Pat. No. 6,014,423 and U.S. Pat. No. 6,014,099 and earlier studies [M. Montel, *X-ray Microscopy and Microradiography*, Academic Press, New York, pp. 177–185, 1957; V. E. Cosslett and W. C. Nixon, *X-Ray Microscopy*, Cambridge, At The University Press, p. 108 ff, 1960; *Encyclopedia of Physics*, ed. S. Flügge, Vol. XXX: *X-Rays*, Springer Berlin, p. 325 ff, 1957; Kirkpatrick-Baez, see e.g. FIG. 1 in U.S. Pat. No. 6,041,099] through combination of two macroscopically substantially flat reflectors, i.e. through double reflection. Since at least two reflectors must be used which must be precisely mutually aligned, the costs and the adjustment effort are substantial. Moreover, the use of two reflectors results in intensity loss. Since even the best multi-layer reflectors lose efficiency, in particular when used with extended X-ray sources (e.g. rotary anodes), an intensity loss of 50% per reflection is relatively normal for increased extension of the sources. However, these reflectors are up to now the only two-dimensionally collimating or focusing multi-layer X-ray reflectors according to prior art.

For these reasons, all conventional two-dimensionally collimating or focusing rotationally symmetrical X-ray reflectors with sagittal curvature radii in the millimeter range are total reflection mirrors (e.g. WO 0138861 or MICRO-MIRROR™ Bede Scientific). The requirements for the coating are minimal (only one individual layer is required e.g. gold and the layer must only have a sufficient thickness >approximately 30 nm: a homogeneous layer thickness is not required) and meet much lower requirements for the micro roughness of the reflector compared to a multi-layer reflector (for total reflection approximately 1 nm, wherein multi-layer mirrors require a roughness of <0.3 nm according to U.S. Pat. No. 6,226,349). Total reflectors have several substantial disadvantages over multi-layer reflectors. They require even smaller irradiation angles (approximately three times smaller), have corresponding reduced light collecting capacity, and lack monochromaticity. Such total reflectors have no monochromatizing properties but only suppress high-energy X-rays for which the total reflection angle is exceeded at certain geometries.

For these reasons, it is extremely desirable to provide improved methods and processes for producing two-dimensionally collimating or focusing multi-layer coated X-ray reflectors.

This is achieved in accordance with the invention by using two-dimensionally curved multi-layer coated bodies, which are not rotationally symmetrical. The advantages that result from the omission of the auxiliary condition of rotational symmetry, are not obvious and are therefore described in the following examples.

Figure 3:
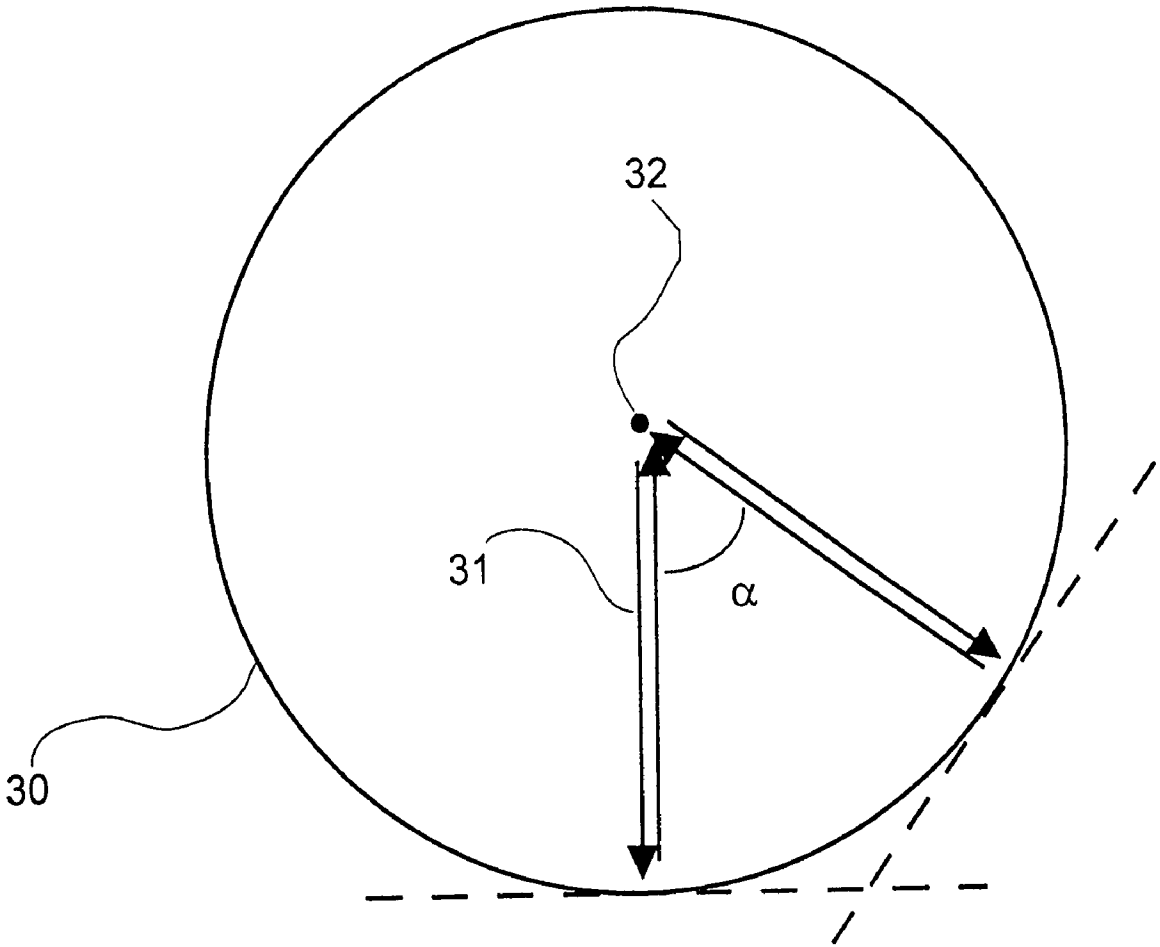
PRIOR ART Fig. 3
FIG. 3 shows a cross-section through a rotationally symmetrical reflector (prior art)
Figure 4:
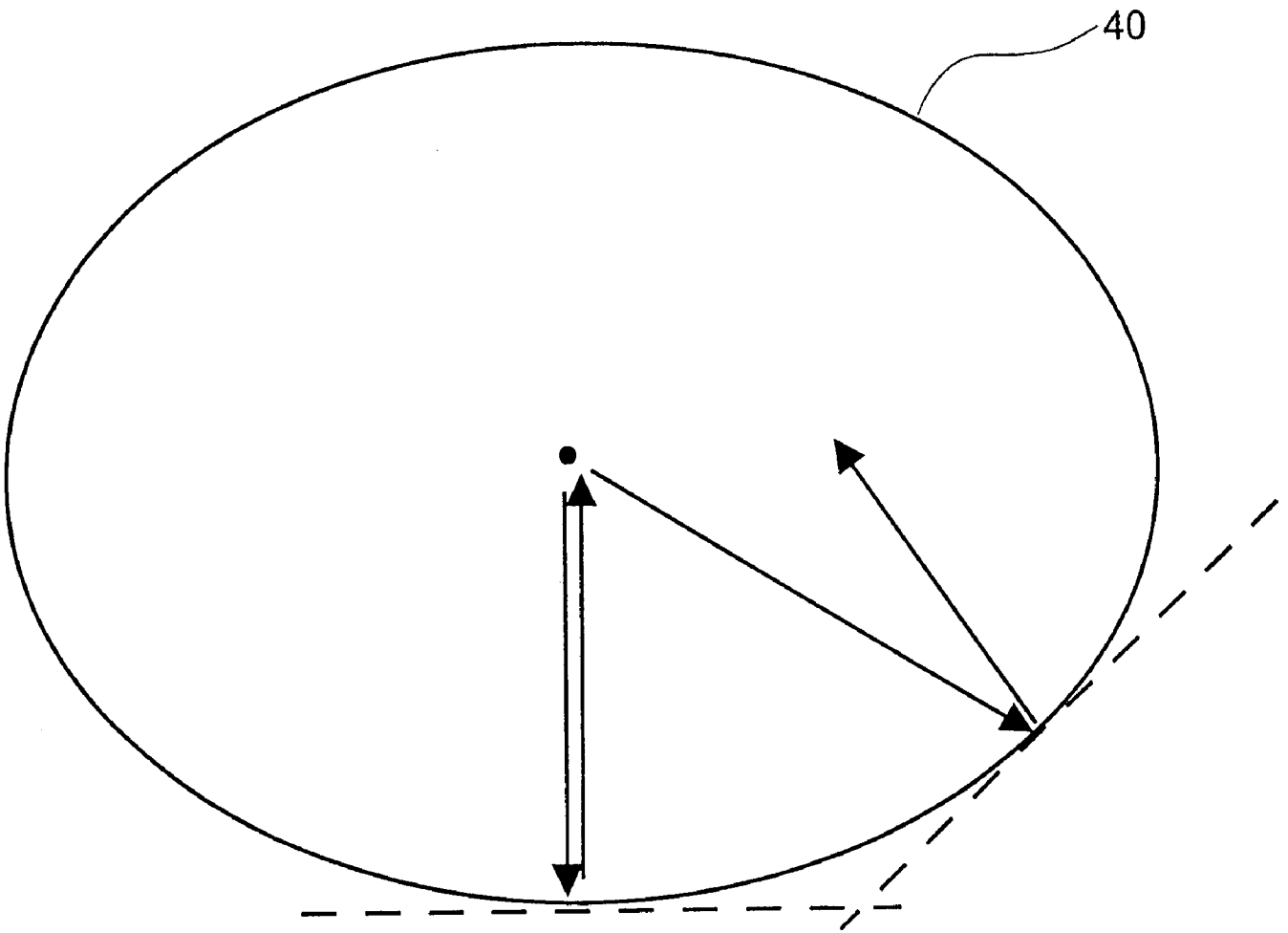
FIG. 4 shows a cross-section through an inventive, non-rotationally symmetrical reflector.

The change from a rotationally symmetrical to a non-rotationally symmetrical reflector is initially disadvantageous. This is shown in FIGS. 3 and 4 with the example of a focusing reflector. While the cross-section of rotationally symmetrical reflectors 30 (FIG. 3) is circular and all rays 31 are reflected perpendicularly to the tangent, to a point 32, this is not the case with non-rotationally symmetrical reflectors 40 (FIG. 4). Non-rotationally symmetrical reflectors therefore produce a focusing loss. The free selection of the cross-section offers some additional possibilities as explained by way of example below. It is important (as shown through calculations) that the focusing loss is horizontal (in width) but not vertical (in height). The reason therefor is that the magnification ratio (source size to image size) of such reflectors is nearly independent of the cross-sectional shape of the reflector. This surprising property can finally be traced back to the high eccentricity of the reflectors relevant in this case (see below).

Figure 5:
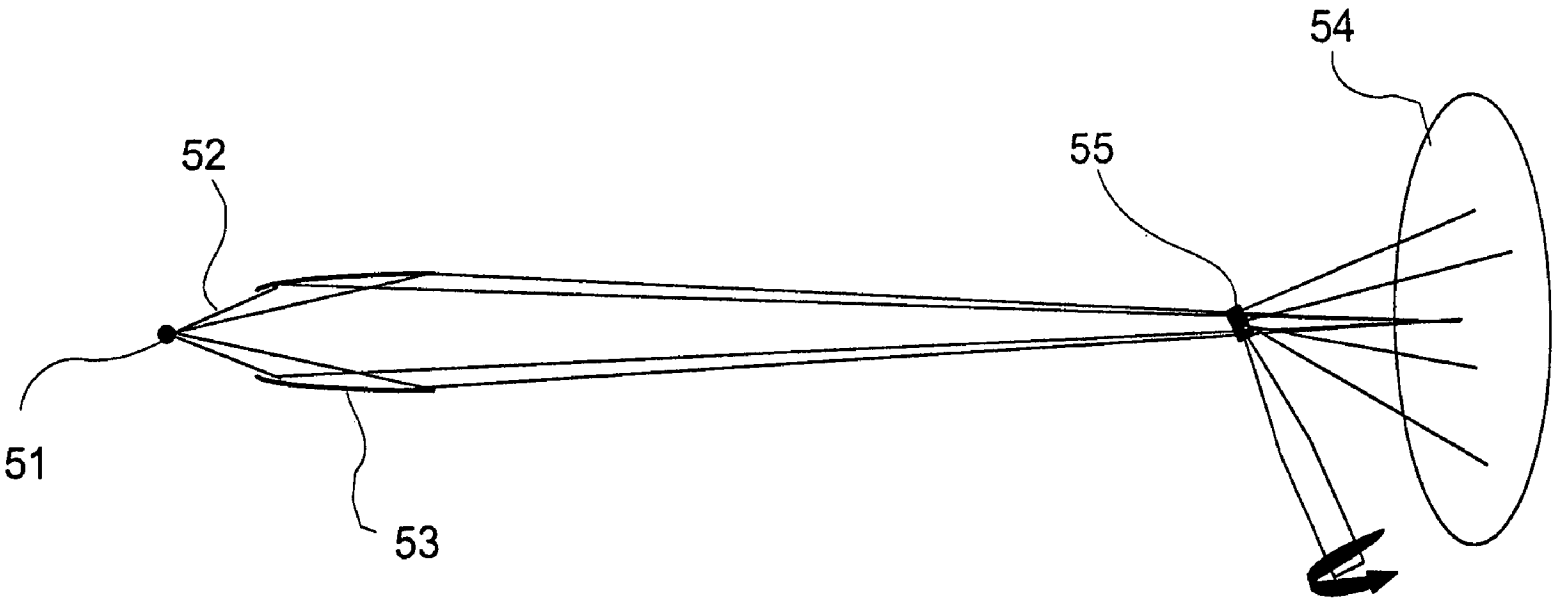
PRIOR ART Fig. 5
FIG. 5 shows the construction of a monocrystal diffractometer for protein crystallography according to prior art.
Figure 6:
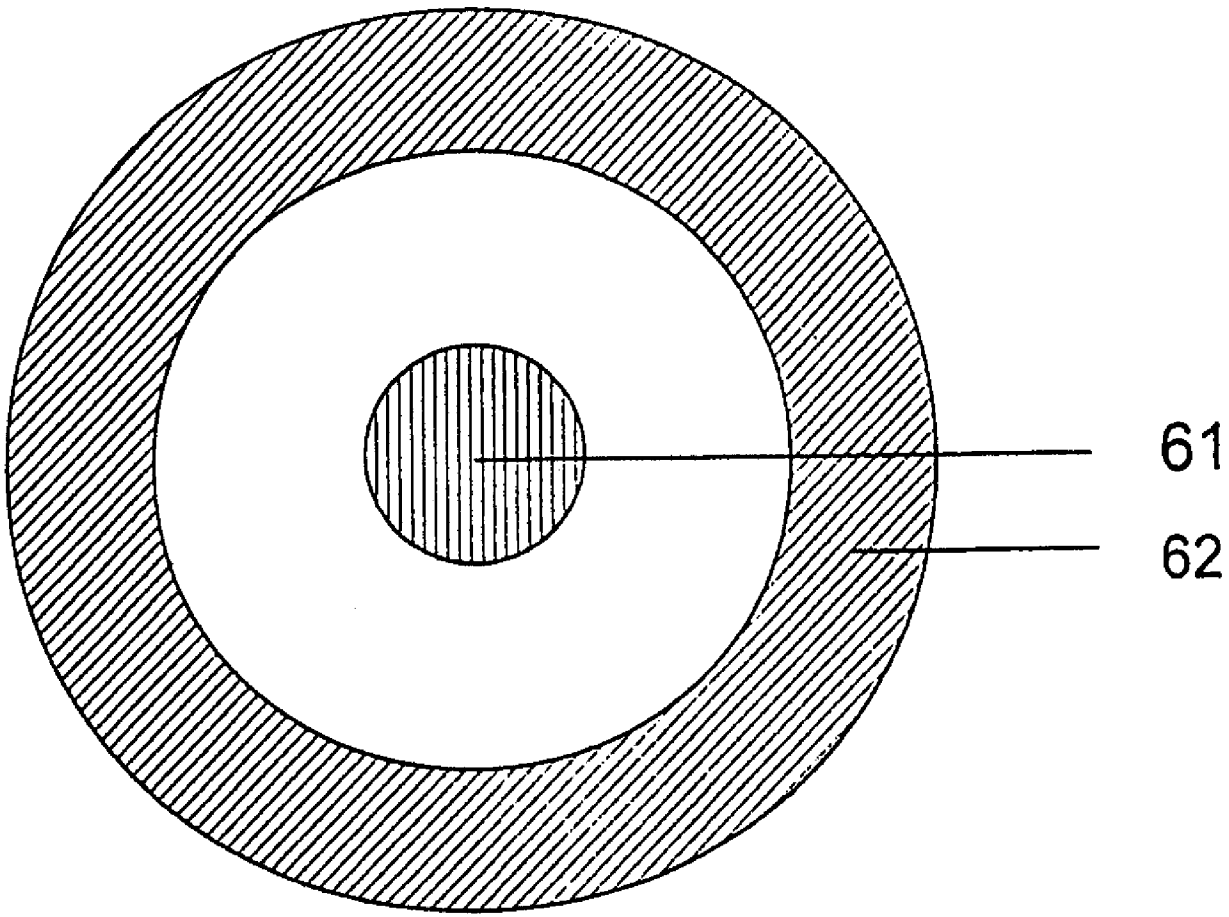
PRIOR ART Fig. 6
FIG. 6 shows the beam image of a rotationally symmetrical, focusing reflector in the image focus and outside of the image focus (prior art)

FIG. 5 shows a typical application (a so-called monocrystal diffractometer). The X-ray radiation 52 emanating from an X-ray source 51 (with collimator 200 μm) is focused onto the two-dimensional detector 54 by a rotationally symmetrical reflector 53 (e.g. MICROMIRROR). Due to the finite size of the X-ray source (e.g. 0.1 mm diameter), the beam image at the image focus 61 (see FIG. 6) is also typically some 0.1 mm. The sample 55 typically has a diameter of 0.5 mm and is typically located 10 cm in front of the detector 54. The beam shape 62 is annular at this location. The sample 55 is thereby not optimally illuminated. Conversely, disadvantages occur when the sample is placed at the focus, since the scattered radiation is not point-like at the detector. The fundamentally annular beam profile 62 outside of the image focus is generally disadvantageous.

Figure 7:
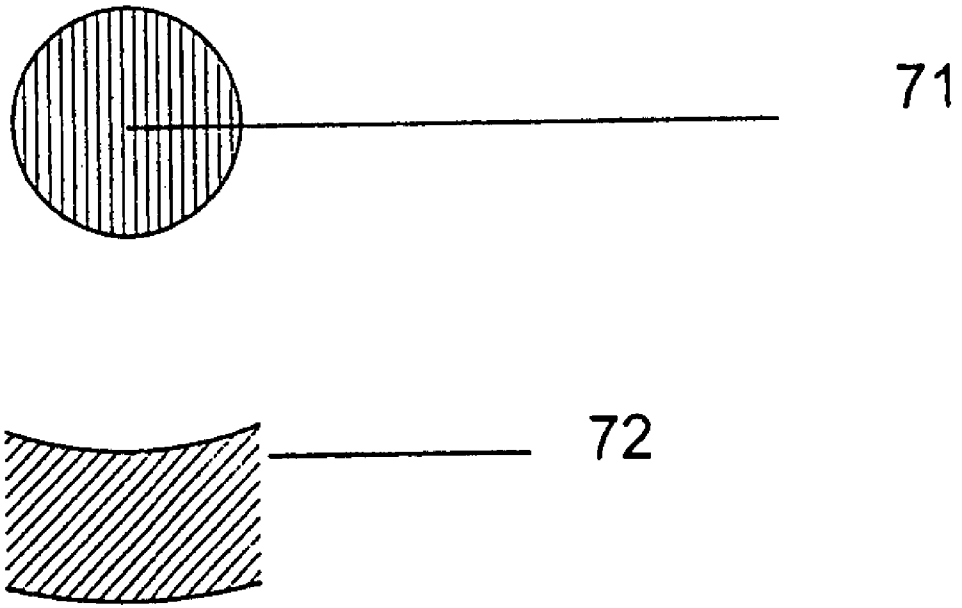
PRIOR ART Fig. 7
FIG. 7 shows the beam image of a segment of a two-dimensional focusing reflector in the image focus and in front of the image focus (prior art)

For this reason, it is sufficient or even advantageous to use only a part (only a segment) of the entire reflector for such applications. FIG. 7 shows that the beam image in the focus 71 (detector) and outside of the focus 72 (sample) has approximately the same size for this section of the reflector. Suitable selection of the reflector and size of the reflector section leads to beam dimensions which are appropriate for the application at hand.

Figure 8:
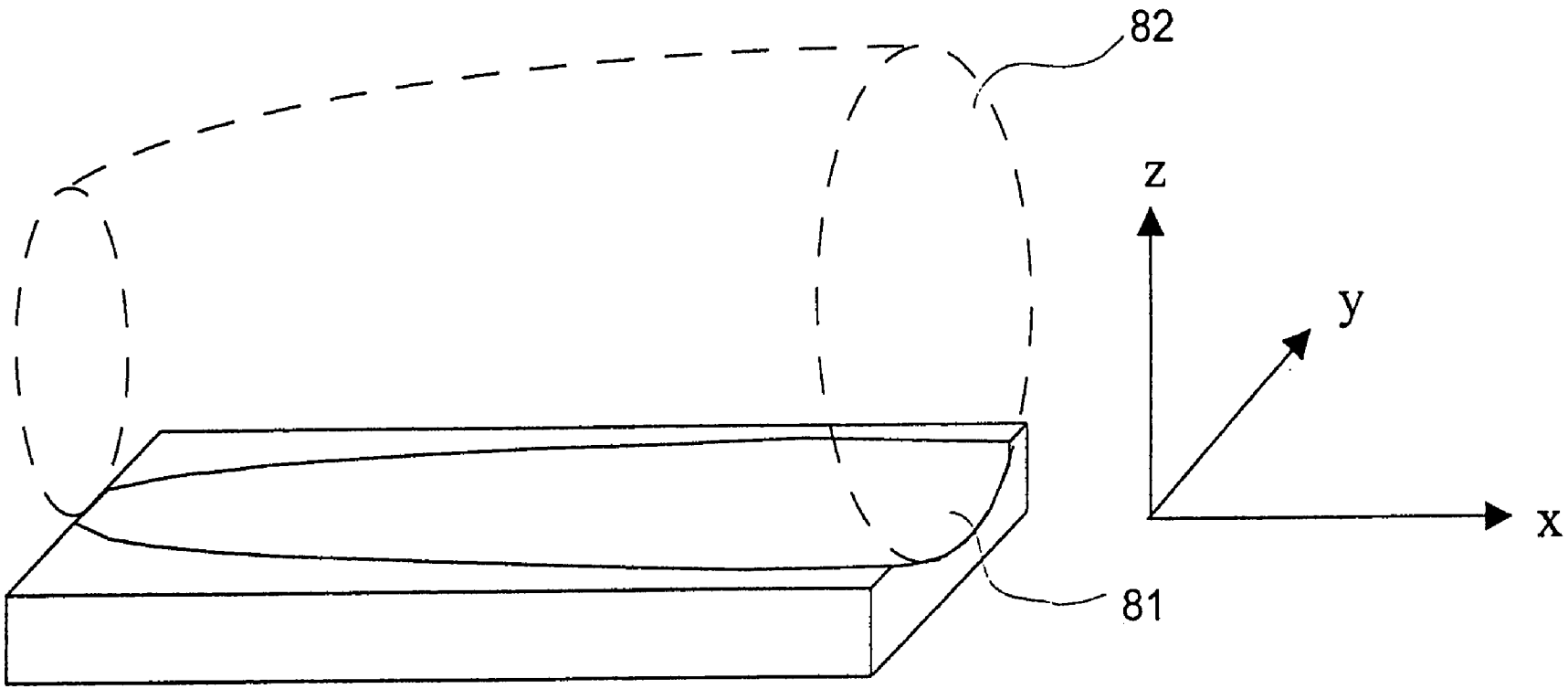
Fig. 8 PRIOR ART
FIG. 8 shows a section of a rotationally ellipsoidal focusing reflector (prior art)

An ellipsoidal reflector section 81 corresponding to FIG. 8 is described by way of example below. The shape of the ellipsoid 82 is described by $$\frac{(x-a)^2}{a^2}+\frac{y^2}{b^2}+\frac{z^2}{c^2}=1$$

b=c produces a rotationally symmetrical ellipsoid with circular cross-section (prior art). b≠c produces an inventive non-rotationally symmetrical ellipsoid with elliptical cross-section (all cross-sectional shapes are possible in accordance with the invention). Typical values for a, b and c are a=250 mm, b=5 mm, and c=5 mm. This produces a separation between source and image focus of 2*a*=500 mm and a maximum diameter of the reflector 2*b*=10 mm. As described above, the necessity of the short curvature radius in the y-z plane results from the auxiliary requirements for small angles of incidence.

Figure 9:
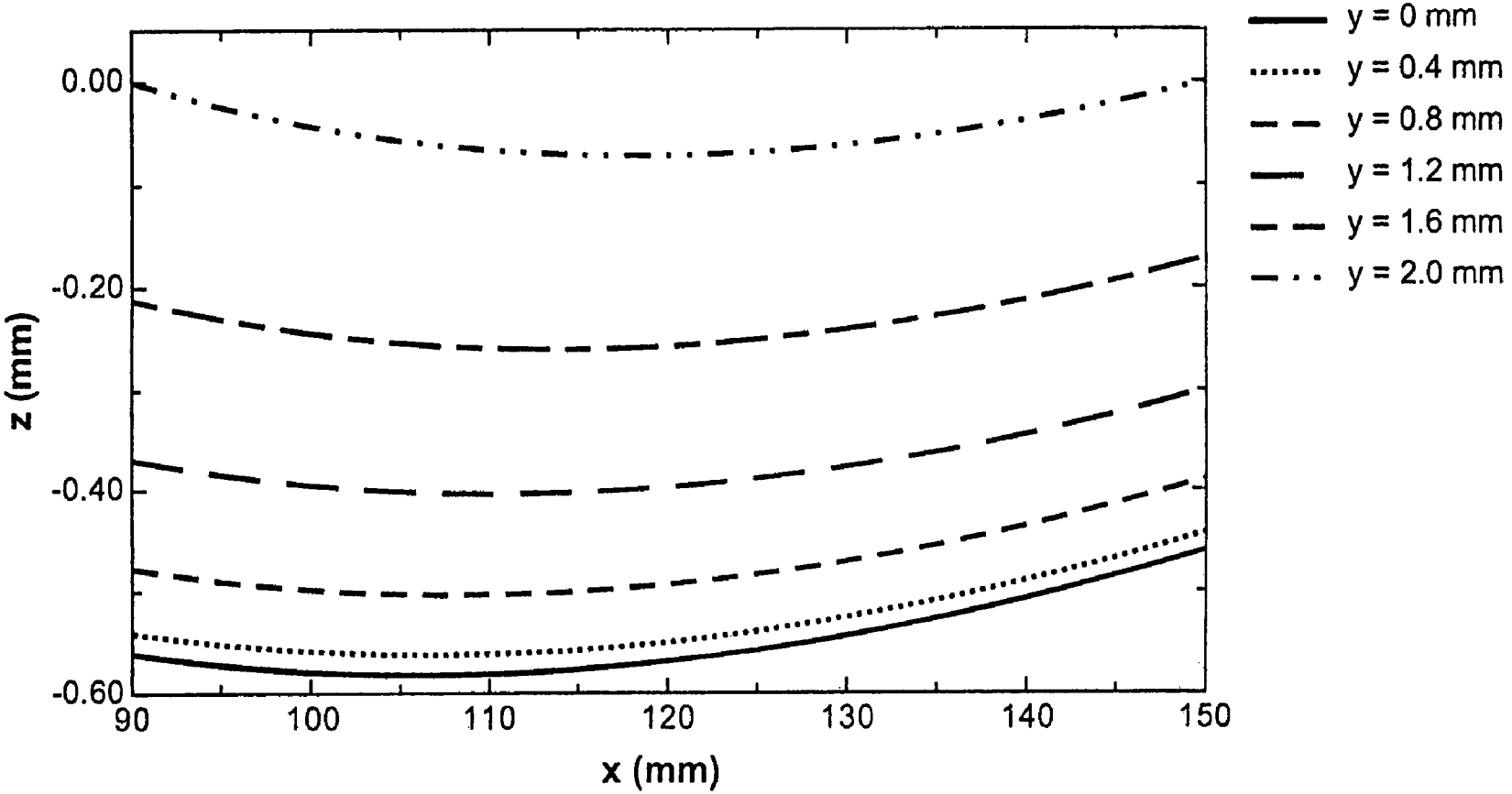
PRIOR ART Fig. 9
FIG. 9 shows the depth dependence of the reflector of FIG. 8 in the x direction.
Figure 10:
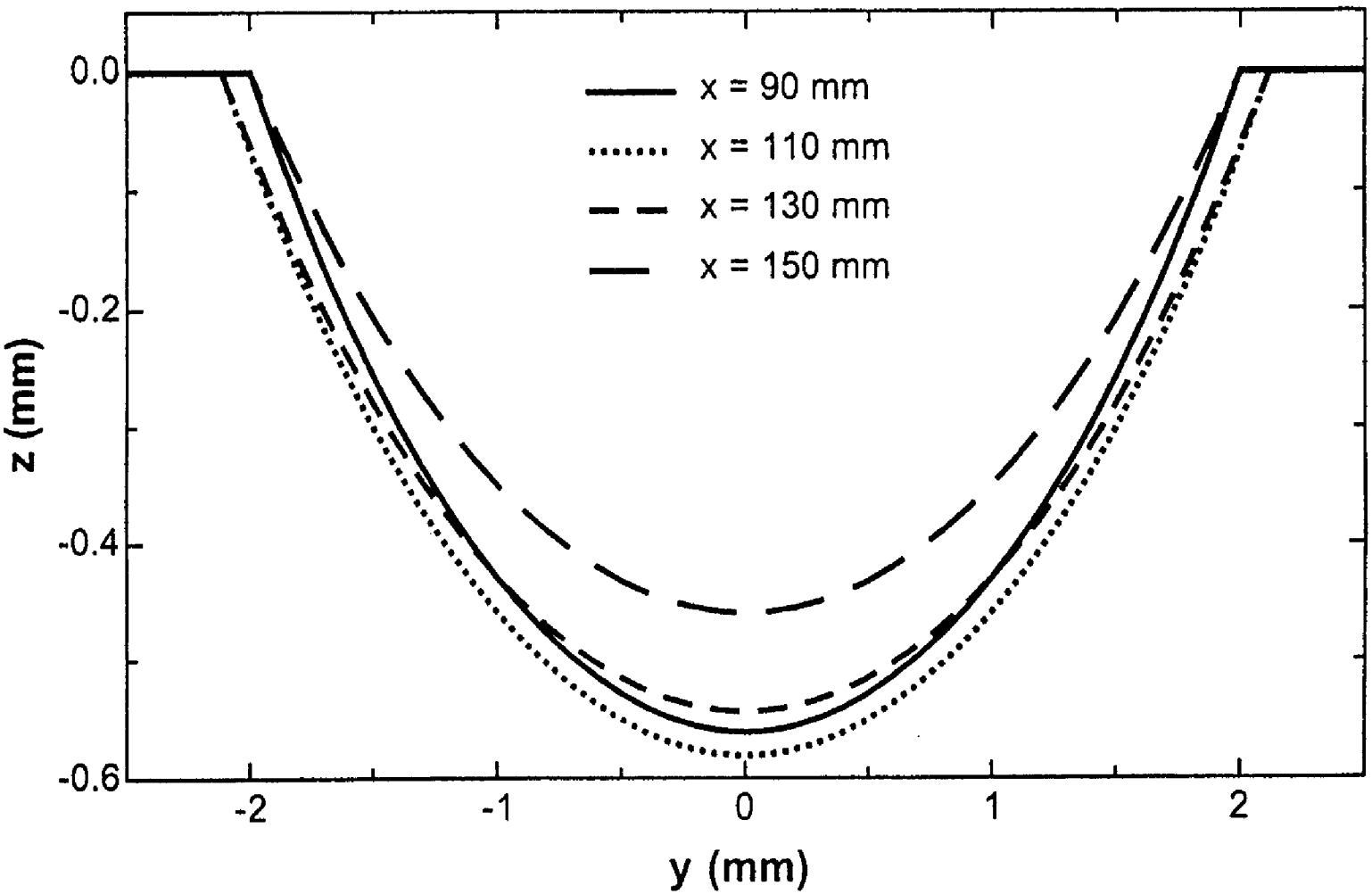
PRIOR ART Fig. 10
FIG. 10 shows the depth dependence of the reflector of FIG. 8 in the y direction.
Figure 11:
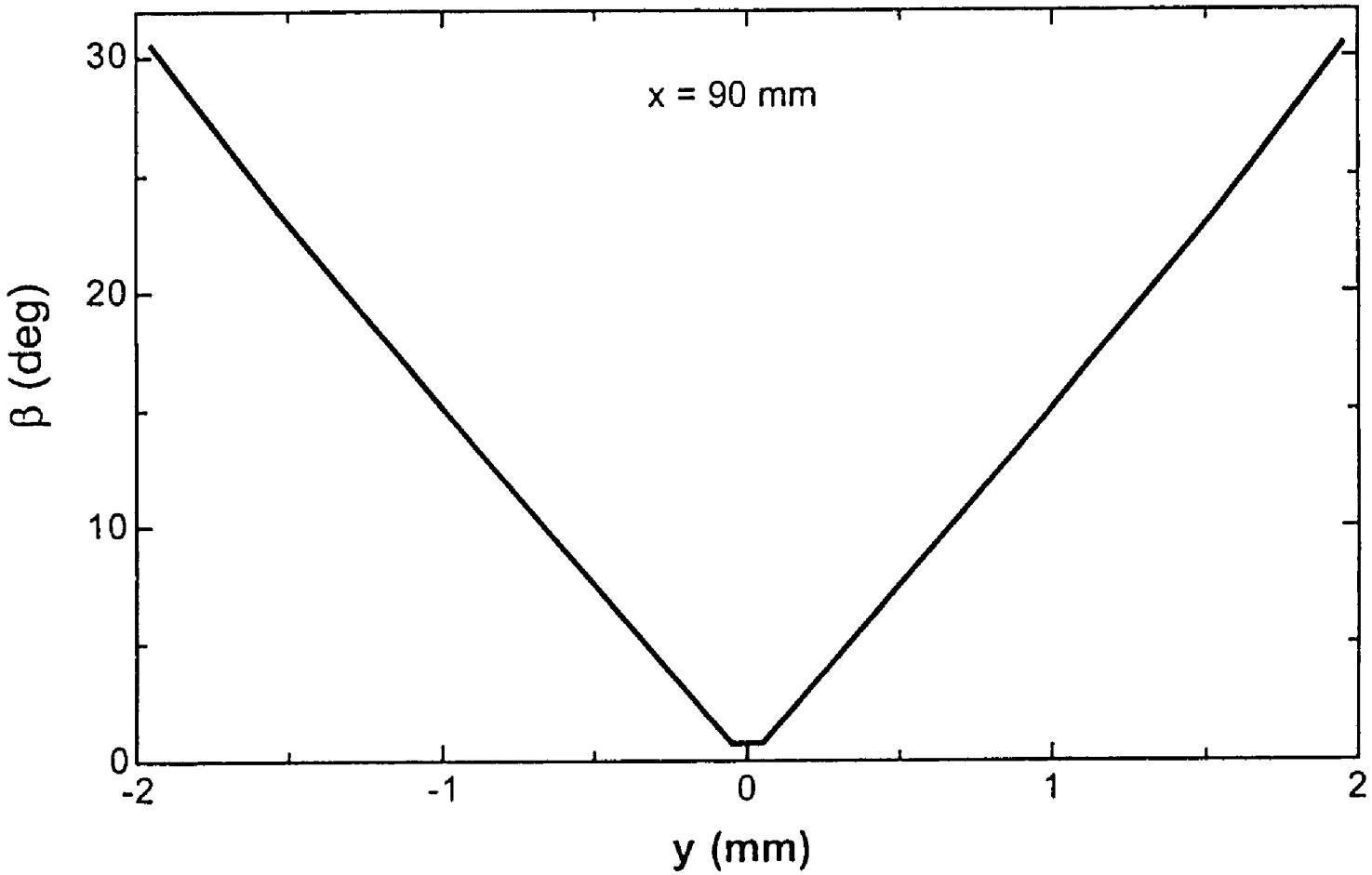
FIG. 11 shows the local angle of inclination of the reflector surface of the reflector of FIG. 8 along the y-axis at x=90 mm.
Figure 12:
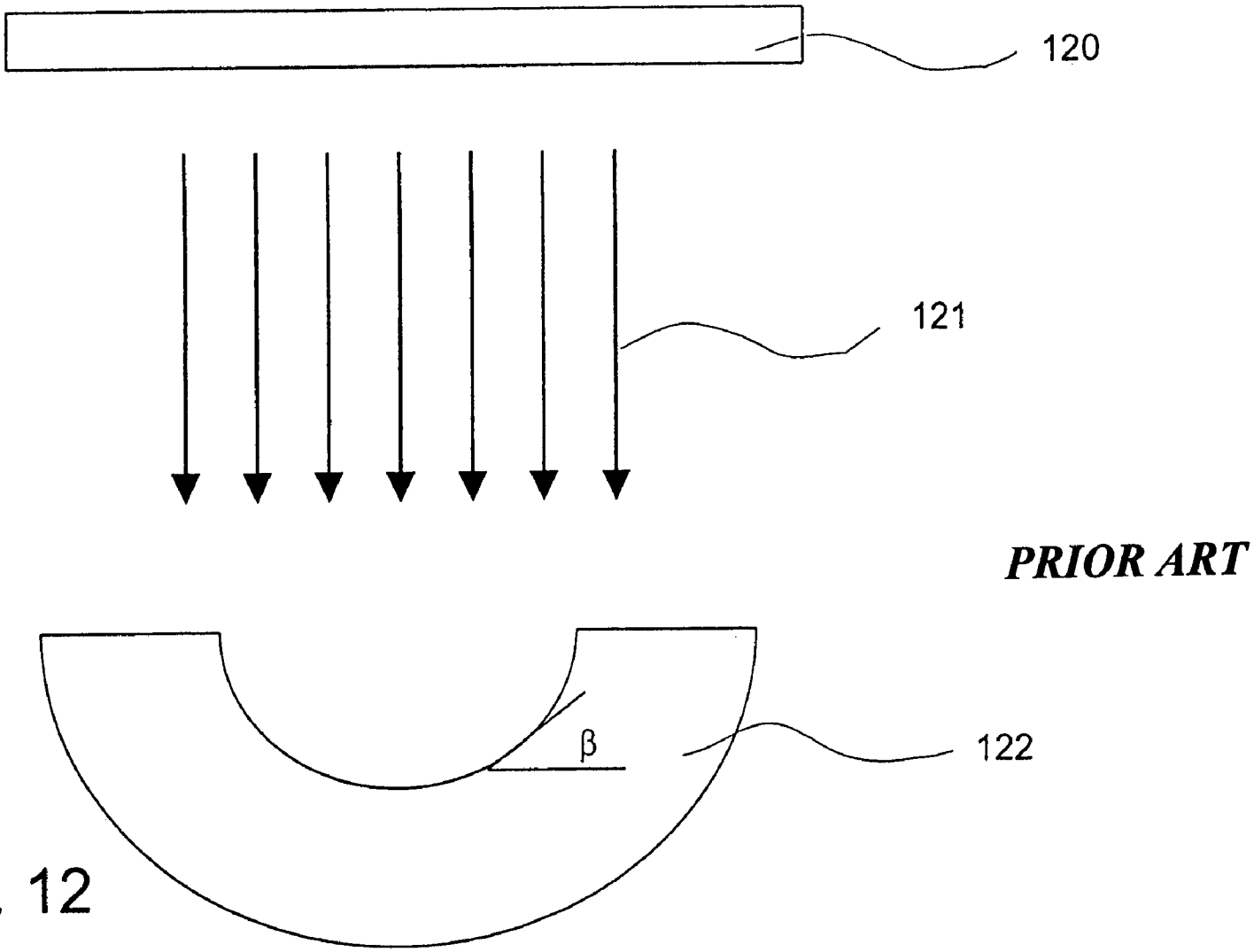
FIG. 12 shows the structure of a conventional coating device for coating a reflector without prevention of coating errors (prior art)
Figure 13:
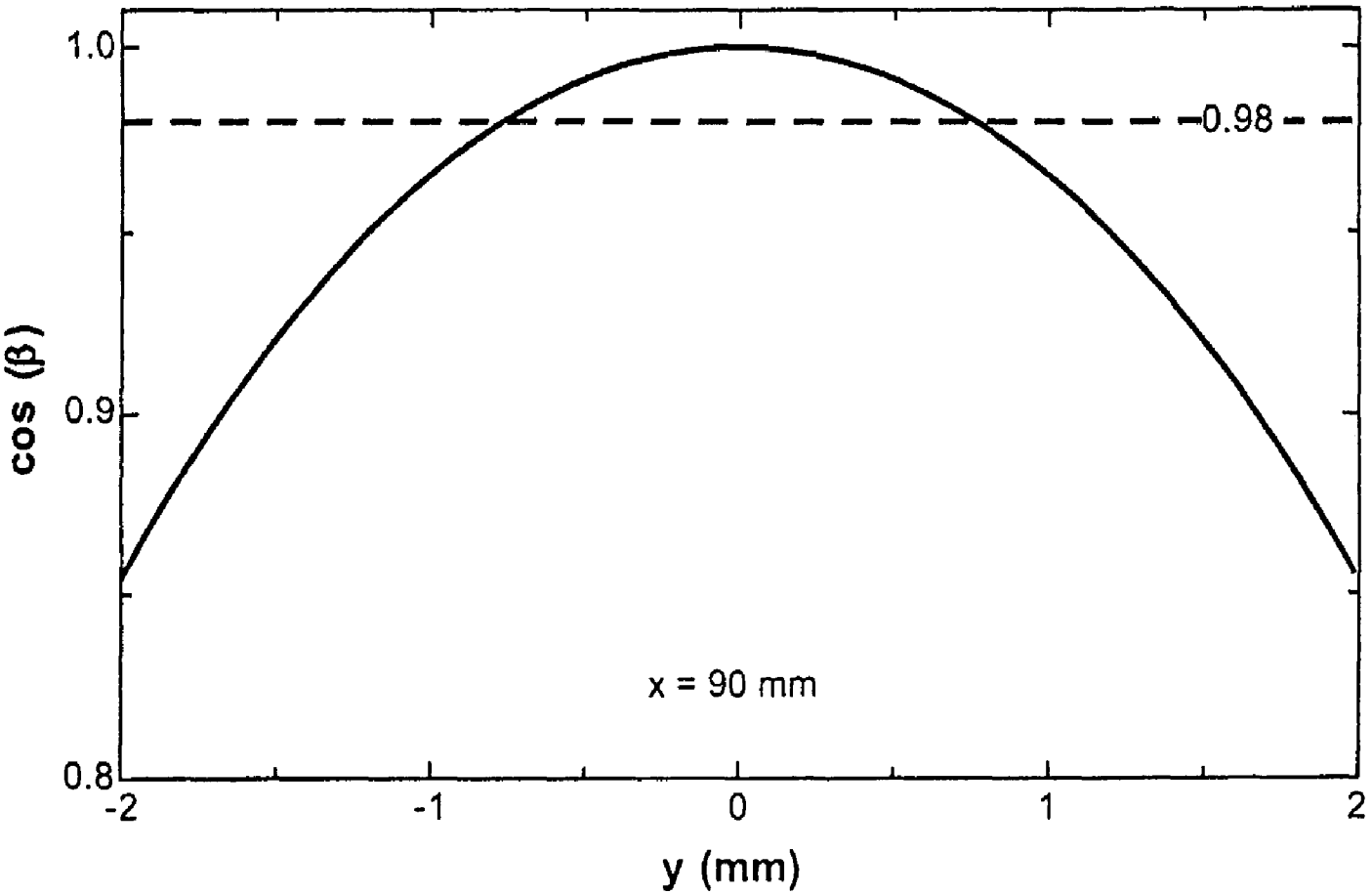
PRIOR ART Fig. 13
FIG. 13 shows the behavior of the relative coating thickness (coating error) at the reflector surface of the reflector of FIG. 8 in the y-direction at x=90 mm.

FIGS. 9 and 10 show the corresponding depth profiles along x and y for a 4 mm wide reflector section. The curves are substantially flat in the x direction (FIG. 9) and have a drop depth (in the z direction) of some ten micrometers over a length of some ten millimeters, i.e. have a large radius of curvature of typically several meters. The curves along y in accordance with FIG. 10 are macroscopically curved and have a drop depth of several hundred micrometers over a width of 4 mm, i.e. have a small radius of curvature in the range of several millimeters. FIG. 11 shows that this strong curvature in the y-z plane produces considerable inclination of the edge of the reflector relative to the horizontal. At the edge of the 4 mm wide reflector, angles of inclination β of approximately 30 degrees occur. This edge inclination produces considerable problems for coating, which must be homogeneous in the y-z plane for a rotationally symmetrical body (in addition to the already mentioned layer thickness gradient along x according to prior art and the extremely high precision required and described therein). The coating methods used for producing X-ray reflectors such as "sputtering" according to U.S. Pat. No. 6,226,349 generally use coating sources with a more or less directed material beam. This has the consequence that, when inclined or tilted surfaces are coated, less material condenses per unit surface than with frontal coating, in dependence on the angle of inclination β (see FIG. 12 with coating source 120, material ray 121, mirror substrate 122 and angle of inclination β). Sputtering produces e.g. approximately a layer thickness distribution which varies with cos(β) wherein β is defined according to β=arctan(dz/dy) (more generally, a dependence with (cos β)" is observed, wherein n depends on the details of the coating process used. The following is based on a process with n=1, without limiting the general case). FIG. 13 shows that with such a coating error (deviation from uniform thickness), the reflector meets the above-mentioned acceptable layer thickness errors of <2% only over a width of less than 2 mm.

Figure 14A:
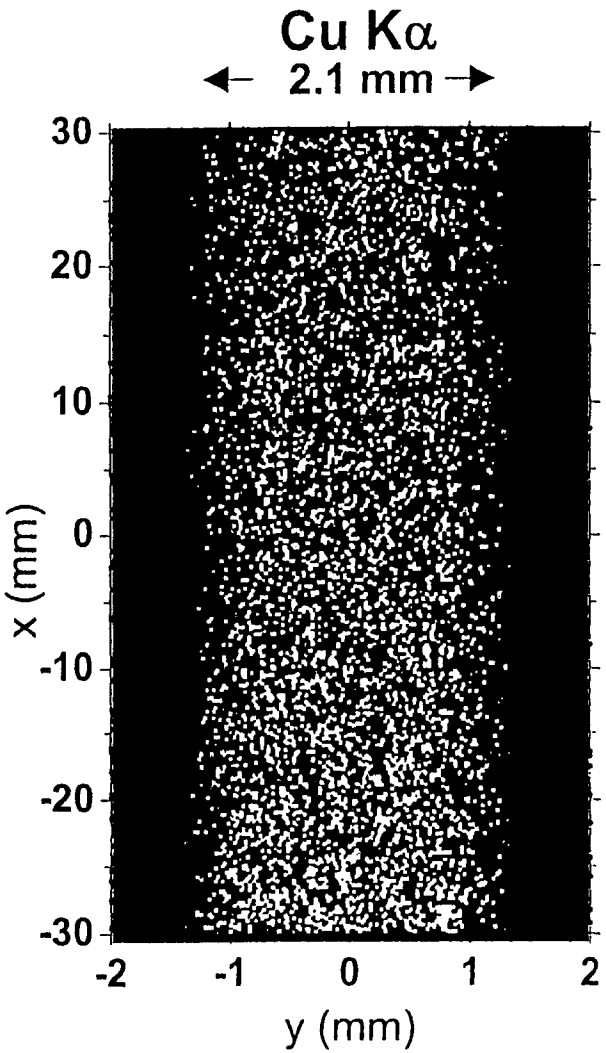
FIG. 14*a* shows the reflectivity over the surface of a rotationally-ellipsoidal reflector with dimensions 60×4 mm assuming a cos(β)-coating error for Cu—Kα-radiation.
Figure 14B:
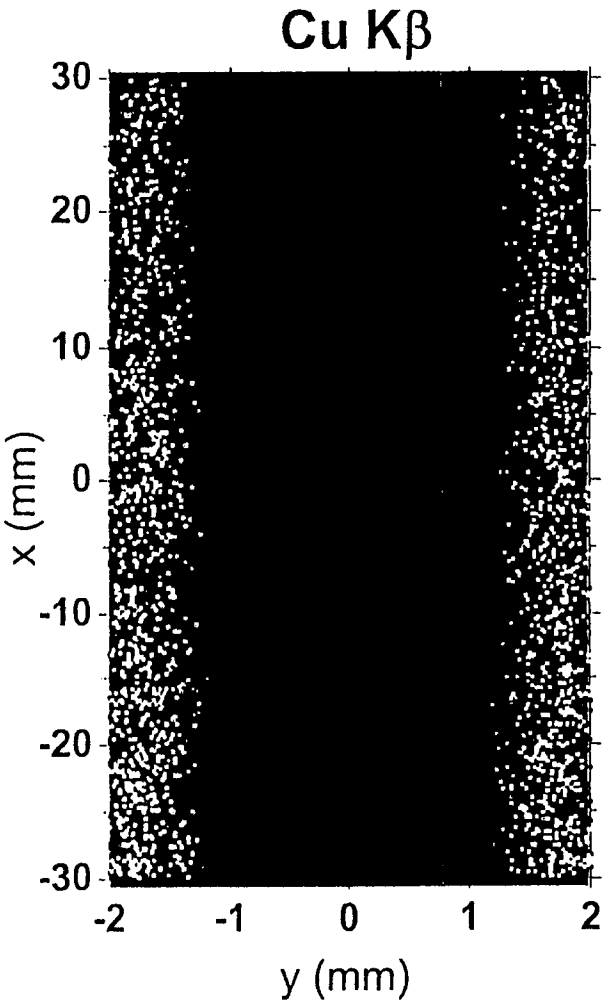
FIG. 14*b* shows the reflectivity over the surface of a rotationally ellipsoidal reflector with dimensions 60×4 mm assuming a cos(β)-coating error for Cu—Kβ-radiation.

As shown in FIG. 14, detailed examinations with the Monte-Carlo method (ray tracing) confirm this result (reflectivity for two wavelengths, Cu—Kα and Cu—Kβ, over the surface of a reflector of 60×4 $mm^2$ assuming a cos(β) coating error; light points indicate high reflectivity). These studies also show that the reflector no longer reflects the desired X-ray wavelength in the edge regions (e.g. Cu Kα, FIG. 14*a*), but also starts to reflect another wavelength in these edge regions due to the decreasing layer thicknesses (e.g. Cu Kβ, FIG. 14*b*). The reflector loses intensity and also its monochromatic effect.

Figure 15:
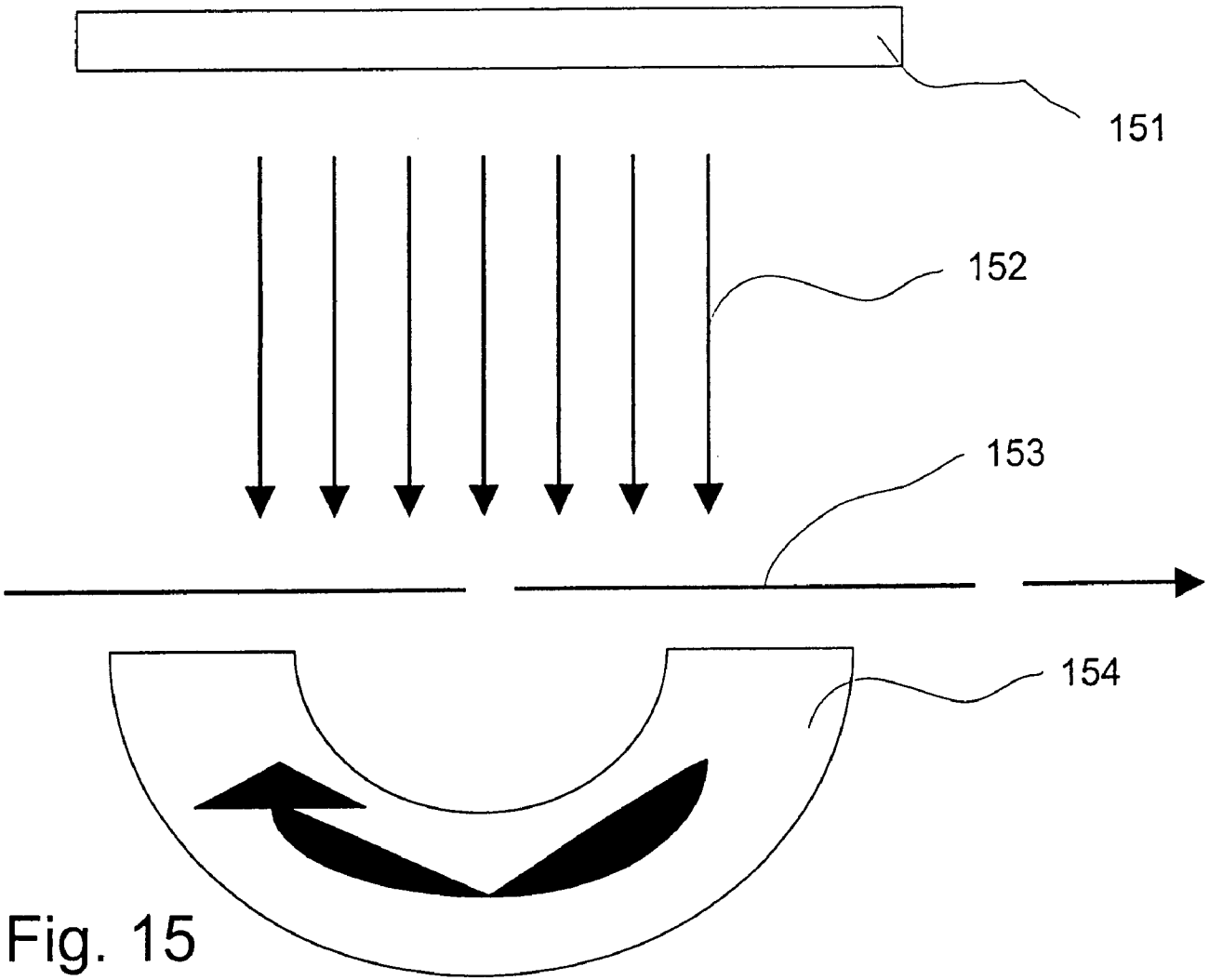
FIG. 15 shows a structure of a coating device for homogeneous coating of a reflector.

For coating such a reflector, additional apparative measures are required to generate a uniform layer thickness along the strongly curved surface. FIG. 15 (coating source 151, material flow 152) shows two possible ways of making the layer uniform. Movement of a diaphragm 153 or suitable pivoting, reciprocating or other turning motions of the mirror substrate 154 or a combination of these measures can lead to a layer which is homogeneous along the strongly curved surface. It is still necessary to keep to the required layer thickness gradient along the x-direction in a likewise extremely precise fashion as described above. Meeting of this condition in the conventional substantially flat reflectors requires considerable effort with regard to the apparatus (see e.g. DE 19701419) since they generally require, in addition to at least one rotary motion or diaphragm shift, measures to stabilize the temperature or other relevant parameters without impairing the substantially high quality of the vacuum. Controlled coating of strongly curved surfaces additionally requires at least one further rotary motion or diaphragm motion, as described above. The additional apparative effort to meet all these requirements for precision coating in the region of some ten picometers over a three-dimensionally curved surface is extremely high and has not been realized up to now.

In contrast thereto, the inventive solution does not require any modification of the conventional coating apparatus. Rather, the deviation from uniform thickness in the coating is compensated for by modification of the curvature of the substrate. Coating systems such as e.g. that of FIG. 10 of U.S. Pat. No. 6,226,349 for producing X-ray reflectors can therefore be used without modification for producing the inventive reflectors. In correspondence with the inventive solution, the semi-axis b of the substrate is changed such that the above-described coating errors are perfectly compensated for non-normal incidence. This Is described In more detail below.

The rotational ellipsoid is preferably expressed in cylindrical coordinates:

$$\frac{(x-a)^2}{a^2}+\frac{r^2}{b^2}=1$$

wherein $z=r\cdot\cos\alpha$ and $y=r\cdot\sin\alpha$.

To ensure optimum reflection of a rotationally ellipsoidal mirror, the coating thickness d must be:

$$d(\alpha)=\text{const.}$$

When a coating error occurs, it can be corrected through variation of b with α. The rotational ellipsoid becomes the general non-rotationally symmetrical ellipsoid $$\frac{(x-a)^2}{a^2}+\frac{r^2}{b^2(\alpha)}=1.$$

b(α) is calculated from $$d(f,\alpha)=\frac{\lambda\cdot b(\alpha)\cdot\sqrt{f\cdot f'}}{2\cdot(b^2(\alpha)-\delta\cdot f\cdot f')}$$

[ see M. Schuster, H. Gobel L. Brügemann, D. Bahr. F. Burgäzy, C. Michaelsen, M. Störmer. P. Ricardo, R. Dietsch, T. Holz and H. Mai "Laterally graded multi-layer optics for X-ray analysis", Proc. SPIE 3767, pp. 183–198, 1999]. One obtains $$b(\alpha)=\frac{1}{2}\cdot\left(\frac{\lambda\cdot\sqrt{f\cdot f'}}{d(f,\alpha)\cdot 2}\right)+\sqrt{\frac{1}{4}\cdot\left(\frac{\lambda\cdot\sqrt{f\cdot f'}}{d(f,\alpha)\cdot 2}\right)^2+\delta\cdot f\cdot f'}.$$

f is the separation between source focus and the observed mirror segment, f' is the separation between the observed mirror segment and image focus. Due to the high eccentricity (a>>b,c) of the reflectors observed herein, f≈x and f'≈2a−x. δ is the dispersion coefficient of the multiple layers used (see e.g. U.S. Pat. No. 6,226,349).

If the irregularity of the coating as described above can be described e.g. by $d(f,\alpha)=d_0(f)\cdot\cos\beta$ with $$\beta=\arctan\frac{dz}{dy}.$$

The angular dependence of the elliptic semi-axis b can be described by $$b(\beta)=\frac{1}{2}\cdot\left(\frac{\lambda\cdot\sqrt{f\cdot f'}}{d_0(f)\cdot\cos\beta\cdot 2}\right)+\sqrt{\frac{1}{4}\cdot\left(\frac{\lambda\cdot\sqrt{f\cdot f'}}{d_0(f)\cdot\cos\beta\cdot 2}\right)^2+\delta\cdot f\cdot f'}$$

The ellipsoidal equation then becomes $$\frac{(x-a)^2}{a^2}+\frac{r^2}{\left(\frac{1}{2}\cdot\left(\frac{\lambda\cdot\sqrt{f\cdot f'}}{d_0(f)\cdot\cos\beta\cdot 2}\right)+\sqrt{\frac{1}{4}\cdot\left(\frac{\lambda\cdot\sqrt{f\cdot f'}}{d_0(f)\cdot\cos\beta\cdot 2}\right)^2+\delta\cdot f\cdot f'}\right)^2}=1.$$

For the further analysis $$1-\frac{(x-a)^2}{a^2}=\frac{r_0^2}{b_0^2}$$

can be defined, which leads to the following equation $$r_0\cdot\left(\frac{1}{2}\cdot\left(\frac{\lambda\cdot\sqrt{f\cdot f'}}{d_0(f)\cdot\cos\beta\cdot 2}\right)+\sqrt{\frac{1}{4}\cdot\left(\frac{\lambda\cdot\sqrt{f\cdot f'}}{d_0(f)\cdot\cos\beta\cdot 2}\right)^2+\delta\cdot f\cdot f'}\right)=r\cdot b_0$$

which, solved for cos β, gives $$\cos\beta=\frac{1}{d_0(f)}\cdot\frac{\lambda\cdot r\cdot b_0 r_0\cdot\sqrt{f\cdot f'}}{2\cdot(r^2\cdot b_0^2-\delta\cdot f\cdot f'\cdot r_0^2)}$$

To determine the cross-sectional shape z=f(y) a numerical solution is recommended—with the initial conditions β(0)=0 and $z(0)=-r_0$. The algorithm is $$\left(\frac{dz}{dy}\right)_i=\tan\beta_i$$

$$z_{i+1}=z_i+\left(\frac{dz}{dy}\right)_i\cdot\Delta y$$

$$y_{i+1}=y_i+\Delta y$$

$$\cos\beta_{i+1}=\frac{1}{d_0(f)}\cdot\frac{\lambda\cdot\sqrt{y_{i+1}^2+z_{i+1}^2}\cdot b_0\cdot r_0\cdot\sqrt{f\cdot f'}}{2\cdot((y_{i+1}^2+z_{i+1}^2)b_0^2-\delta\cdot f\cdot f'\cdot r_0^2)}$$

Refined numerical solutions according to known methods are possible. Ray tracing simulations however show that this solution is sufficiently accurate.

Figure 16:
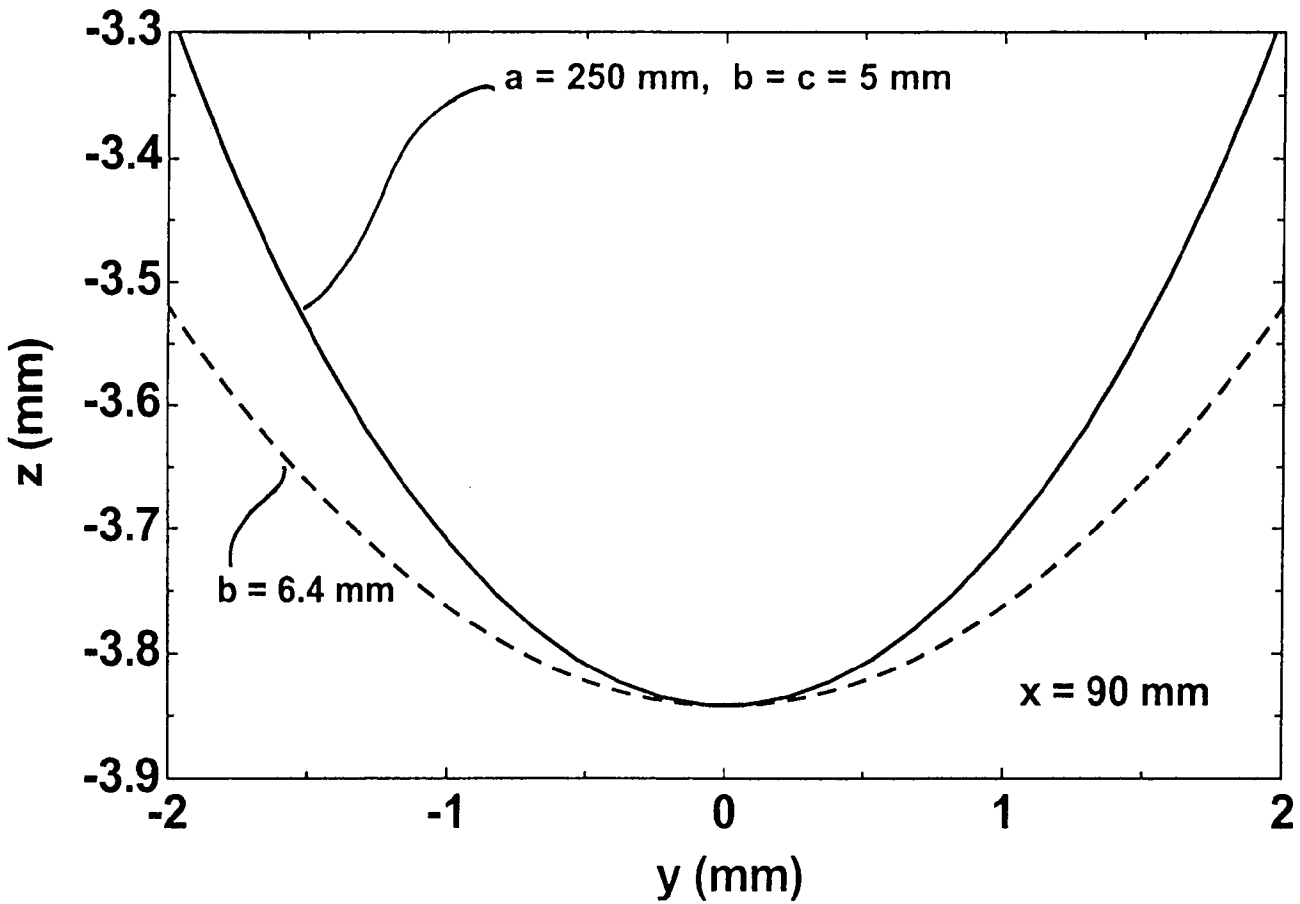
FIG. 16 shows the inventive compensation curve of a cos(β)-coating error using a non-rotationally symmetrical ellipsoid.

The calculated cross-sectional shape is shown in FIG. 16. In contrast to the rotationally symmetrical shape (b=c=5 mm), the shape described herein is flatter and corresponds with good approximation to an ellipsoid with b=6.4 mm and c=5 mm. Ray tracing calculations confirm that an ellipsoid modified in this manner reflects the desired X-ray line over the entire cross-section, despite the coating error. In contrast to FIG. 14*b*, the desired monochromatic effect is also completely maintained. The flatter shape of the inventive solution has moreover only approximately half the edge inclination than the rotationally symmetrical ellipsoid. For this reason, one can expect that the coating problems and the production problems of the curved shape be additionally substantially reduced by the low roughness requirements. Production of the inventive reflectors is therefore simpler and less expensive.

Figure 17:
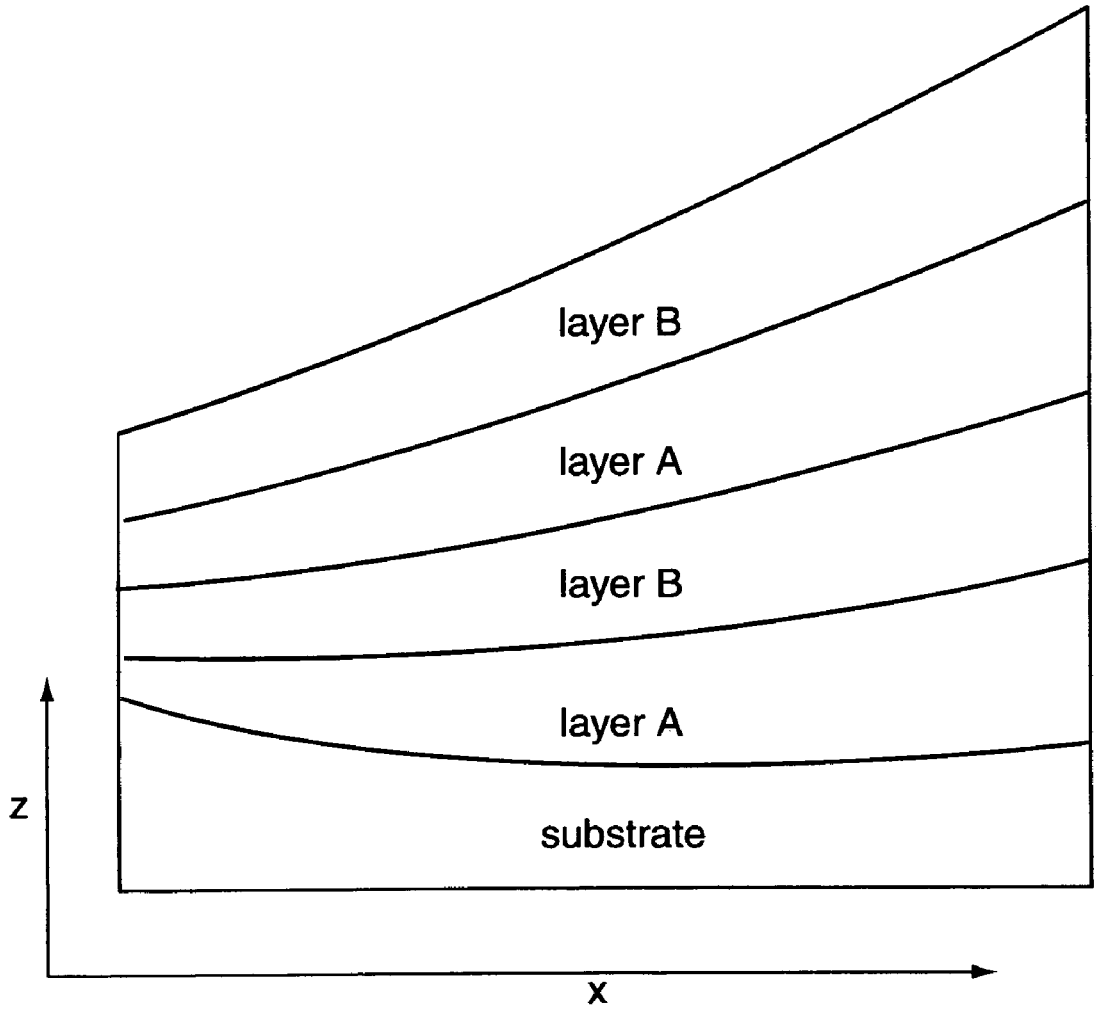
FIG. 17 shows a repeating sequence of layers A,B whose sum of thicknesses changes continuously along the x-direction.
Figure 18:
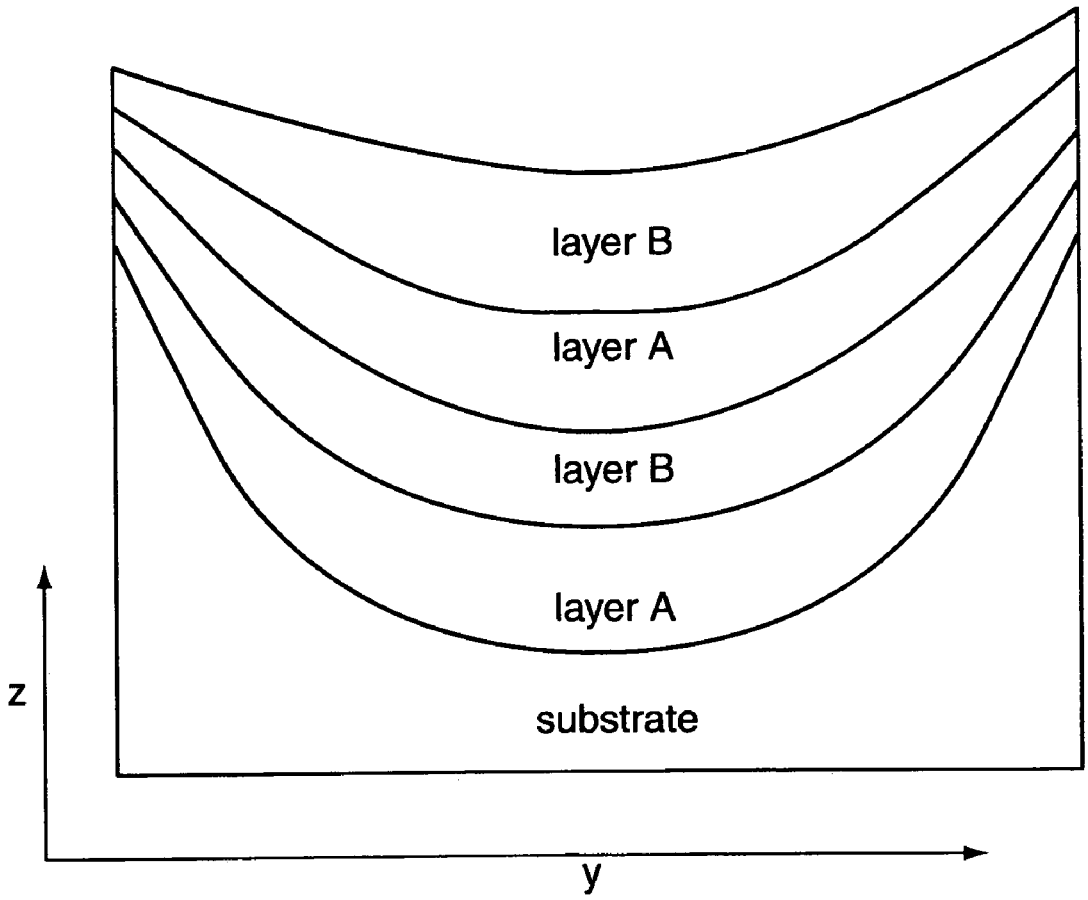
FIG. 18 shows a repeating sequence of layers A,B whose sum of thicknesses changes continuously along the y-direction.

FIGS. 17 and 18 show embodiments of the invention in which a periodic sequence of layers of materials (in this case two materials, A and B) have thicknesses whose sum changes continuously in the x (FIG. 17) and y (FIG. 18) directions.

Figure 19:
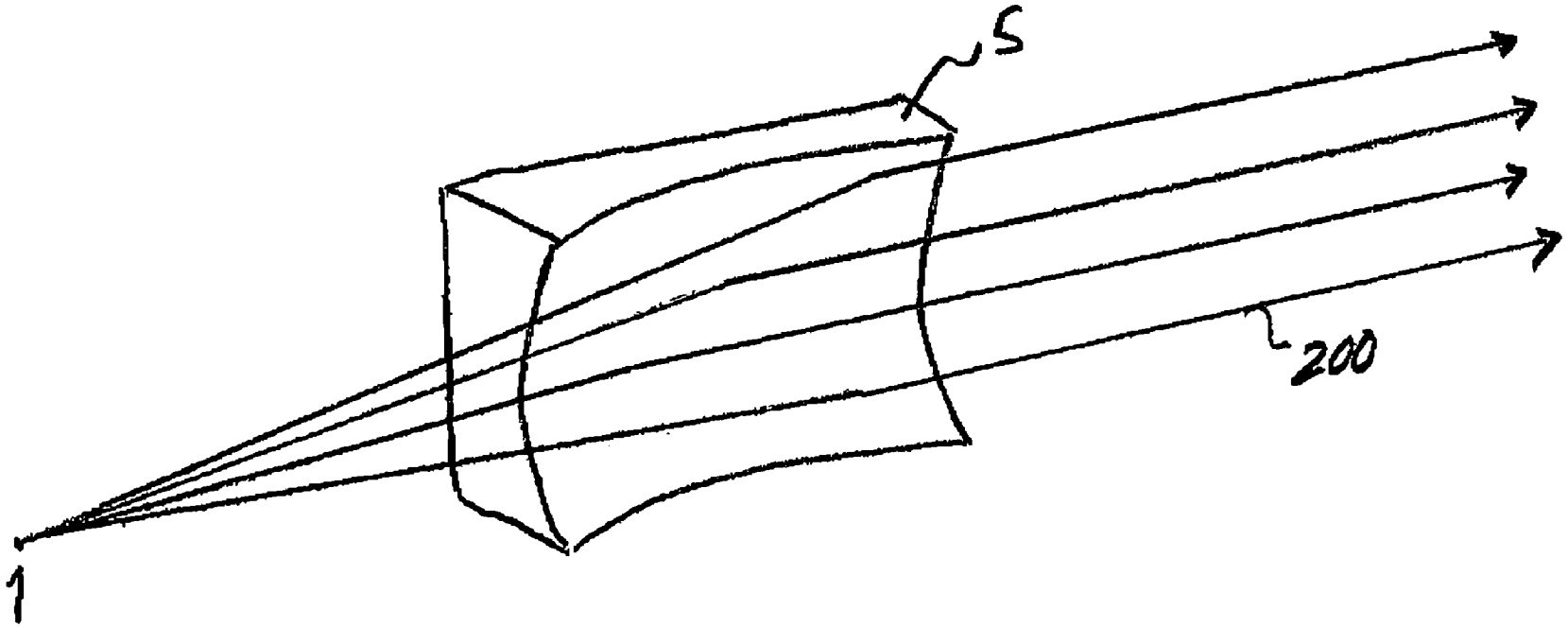
FIG. 19 shows a mirror generating a parallel beam.

FIG. 19 shows an embodiment in which the inventive mirror 5 reflects X-rays from a source 1 to form an parallel outgoing beam 200.

Analog to the above-described method, a non-rotationally symmetrical paraboloid can be calculated to parallelize rather than focus the beam. The rotation paraboloid with the parabolic parameter p is preferably expressed in cylindrical coordinates:

$$r^2=2\cdot p\cdot x$$

wherein $z=r\cdot\cos\alpha$ and $y=r\cdot\sin\alpha$.

To ensure optimum reflection of a rotationally paraboloid mirror, the following must be true for the coating thickness d:

$$d(\alpha)=\text{const.}$$

A coating error can be corrected through variation of p with α. The paraboloid of rotation then becomes the generally non-rotationally symmetrical paraboloid.

$$r^2=2\cdot p(\alpha)\cdot x.$$

p(α) is calculated according to $$d(f,\alpha)=\frac{\lambda\cdot\sqrt{2\cdot p(\alpha)\cdot f}}{2\cdot(p(\alpha)-2\cdot\delta\cdot f)}$$

[ see M. Schuster. H. Göbel. L. Brügemann, D. Bahr. F. Burgäzy. C. Michaelsen, M. Störmer. P. Ricardo. R. Dietsch, T. Holz and H. Mai "Laterally graded multi-layer optics for X-ray analysis", Proc. SPIE 3767pp. 183–198, 1999]. One obtains $$\sqrt{p(\alpha)}=\frac{1}{2}\cdot\left(\frac{\lambda\cdot\sqrt{2\cdot f}}{d(f,\alpha)\cdot 2}\right)+\sqrt{\frac{1}{4}\cdot\left(\frac{\lambda\cdot\sqrt{2\cdot f}}{d(f,\alpha)\cdot 2}\right)^2+2\cdot\delta\cdot f}\,.$$

If the irregularity of the coating can again be described as $d(f,\alpha)=d_0(f)\cdot\cos\beta$, wherein $\beta=\arctan dz/dy$, the angular dependence of the parabolic parameter p is given by $$\sqrt{p(\beta)}=\frac{1}{2}\cdot\left(\frac{\lambda\cdot\sqrt{2\cdot f}}{d_0(f)\cdot\cos\beta\cdot 2}\right)+\sqrt{\frac{1}{4}\cdot\left(\frac{\lambda\cdot\sqrt{2\cdot f}}{d_0(f)\cdot\cos\beta\cdot 2}\right)^2+2\cdot\delta\cdot f}$$

The paraboloid equation then becomes $$r^2=2\cdot\left(\frac{1}{2}\cdot\left(\frac{\lambda\cdot\sqrt{2\cdot f}}{d_0(f)\cdot\cos\beta\cdot 2}\right)+\sqrt{\frac{1}{4}\cdot\left(\frac{\lambda\cdot\sqrt{2\cdot f}}{d_0(f)\cdot\cos\beta\cdot 2}\right)^2+2\cdot\delta\cdot f}\right)^2\cdot x$$

For further analysis $$x=\frac{r_0^2(x)}{2\cdot p_0}$$

can be defined. The result is $$r_0\cdot\left(\frac{1}{2}\cdot\left(\frac{\lambda\cdot\sqrt{2\cdot f}}{d_0(f)\cdot\cos\beta\cdot 2}\right)+\sqrt{\frac{1}{4}\cdot\left(\frac{\lambda\cdot\sqrt{2\cdot f}}{d_0(f)\cdot\cos\beta\cdot 2}\right)^2+2\cdot\delta\cdot f}\right)=r\cdot p_0,$$

which, solved for cos β, becomes $$\cos\beta=\frac{1}{d_0(f)}\cdot\frac{\lambda\cdot\sqrt{2\cdot r\cdot p_0\cdot r_0\cdot f}}{2\cdot(r\cdot p_0-2\cdot\delta\cdot f\cdot r_0)}$$

To determine the cross-sectional shape z=f(y) a numerical solution is recommended—with the initial conditions β(0)=0 and $z(0)=-r_0$.

The algorithm is:

$$\left(\frac{dz}{dy}\right)_i=\tan\beta_i$$

$$z_{i+1}=z_i+\left(\frac{dz}{dy}\right)_i\cdot\Delta y$$

$$y_{i+1}=y_i+\Delta y$$

$$\cos\beta_{i+1}=\frac{1}{d_0(f)}\cdot\frac{\lambda\cdot\sqrt{2\cdot\sqrt{y_{i+1}^2+z_{i+1}^2}\cdot p_0\cdot r_0\cdot f}}{2\cdot\left(\sqrt{y_{i+1}^2+z_{i+1}^2}\cdot p_0-2\cdot\delta\cdot f\cdot r_0\right)}$$

Refined numerical solutions according to conventional methods are possible. Ray tracing simulations, however, show that the solution shown herein provides sufficient accuracy.

The two approaches described above are to be understood as examples only and analog approaches are possible for other coating errors (e.g. parabolic, $(\cos\beta)^n$) and other reflector shapes (e.g. spherical, hyperboloid, . . . ).

The curved reflector substrates can be produced in a manner known per se e.g. by grinding, polishing, and lapping of solid bodies of quartz, Zerodur, glass or other materials. Roughnesses below 0.1 nm (already 0.3 nm is satisfactory for multi-layers) and curvature errors below 5 μrad (already less than 25 μrad produces very good mirrors) were routinely obtained for reflectors according to U.S. Pat. No. 6,226,349 using such methods. These values lead to exceptional optical properties. Further shaping techniques of the reflector substrates are bending technologies [e.g. DE 19935513] or copying/replication techniques [U.S. Pat. No. 4,525,853 claim 12].

The advantages of the inventive teaching can be summarized as follows:

a) the production of the shape is facilitated since flatter shapes with less curvatures and edge angles can be used. The flatter shape facilitates polishing to reduce roughness.

b) Selection of the cross-sectional shape permits further favorable influence on the radiation properties (beam size, divergence), e.g. to produce a wider beam depending on the application. To determine mechanical tensions or textures of materials with X-ray diffractometric methods, it is desired to illuminate a larger sample surface (in contrast to monocrystal diffractometry). Selection of a non-rotationally symmetrical reflector provides a larger selection of optics optimized for the application. The optical design permits more flexibility.

c) Especially for multi-layer X-ray mirrors the following is also true: Coating errors in a transverse direction can be completely compensated for through (free!) selection of the cross-sectional shape of the body in this direction. The coating becomes then "very" simple" or becomes possible for the first time with the same techniques which are currently used for substantially flat optics.

d) Intensity is considerably increased since, in contrast to prior art, only one reflection is required (intensity loss per reflection approximately 50%) and since a larger mirror surface can be used. Conventional reflectors are used within a width of only approximately 1 mm. In contrast thereto, a 4 mm wide reflector was described (without limitation of the general case). In total, an intensity gain by a factor of 8 can be expected.

e) Only one mirror is required instead of the optics according to prior art having 2 mirrors (cost factor).

f) Adjustment of the reflector is much easier than for a Kirkpatrick-Baez arrangement according to prior art.

Due to the particularly advantageous embodiment of the inventive reflector as a Goebel mirror with a non-rotationally symmetrical curvature transverse to the x direction (which corresponds approximately to the main irradiation direction of the X-ray radiation) the design of such an embodiment or of an associated X-ray analysis device is explained in more detail below.

The preferred inventive X-ray analysis device comprises a source emitting X-ray radiation a sample to be analyzed a detector which responds to X-ray radiation optical shaping and/or delimiting means; and a curved multi-layer Bragg reflector which is disposed in the optical path between the source and the sample and comprises a periodically repeating sequence of layers, wherein one period consists of at least two individual layers A, B which have different diffraction index decrements $\delta_A \neq \delta_B$ and thicknesses $d_A$ and $d_B$, wherein the period thickness, i.e. the sum $d=d_A+d_B+\ldots$ of the individual layers A, B, . . . of a period changes continuously along an x-direction, and wherein the reflector is curved such that it forms a partial surface of a paraboloid or ellipsoid in the focal line or focal point at which the source or an image of the source is located, wherein the paraboloid or ellipsoid is curved along a cross-section in a plane perpendicular to the x-direction in a shape which is not that of a circular arc. The paraboloid or ellipsoid is not a rotational paraboloid or ellipsoid, rather a non-rotationally symmetrical paraboloid or ellipsoid.

The embodiments of the inventive X-ray analysis device with parabolic reflector shape have the following properties:

the layers of the reflector are vacuum-evaporated, sputtered or grown directly on a concavely curved suiface of a parabolic hollowed substrate, wherein the curvature of the concave substrate surface in a xz plane follows the formula $z^2=2px$ with 0.02 mm<p<0.5 mm, preferably $p \approx 0.1$ mm;

the concave substrate surface facing the reflector has a maximum admissible shape deviation of $\Delta p=\sqrt{2px}\cdot\Delta\Theta_R$, wherein $\Delta\Theta_R$ is the half-width of the Bragg reflection of the reflector and is in the range $0.01° < \Delta\Theta_R < 0.5°$, preferably $0.02° < \Delta\Theta_R < 0.20°$, the concave substrate surface facing the reflector has a maximum admissible waviness of $$\frac{\Delta z}{\Delta x} = \frac{1}{2}\Delta\Theta_R,$$

the concave substrate surface facing the reflector has a maximum admissible roughness of $$\Delta z = \frac{d}{2\pi},$$

preferably $\Delta z \leqq 0.3$ nm, the X-ray radiation impinges on the curved surface of the reflector at an angle of incidence of $0° \leqq \Theta \leqq 5°$, the periodic thickness d along the x-direction changes such that the X-ray radiation of a certain wavelength $\lambda$ of a point X-ray source always experiences a Bragg reflection irrespective of the point of incidence (x, z) on the reflector in that the periodic thickness d increases in x-direction towards the paraboloid opening according to $$d = \frac{\lambda}{2}\frac{1}{(1-\bar{\delta}/\sin^2\Theta)\sin\Theta} \text{ and } \Theta = \operatorname{arccot}\frac{\sqrt{2px}}{p},$$

wherein $\bar{\delta}$ is the decrease of the average refractive index of the multi-layer Bragg reflector, the deviation $\Delta d/\Delta x$ of the periodic thickness d at each point of the multi-layer Bragg reflector along the x direction is smaller than $$\frac{\Delta d}{\Delta x} = \frac{1}{2}\frac{d}{X},$$

the following is true for the periodic thickness d: 1 nm $\leqq$ d $\leqq$ 20 nm, for the number N of periods 10<N<500, preferably $50 \leqq N \leqq 100$, and the energy E of the light quantum of the X-ray radiation is: 0.1 keV<E<0.1 MeV.

Use of amorphous or polycrystalline substrate material is also advantageous, in particular glass, amorphous Si, polycrystalline ceramic material or plastic material. With regard to the number of individual layers per period, 2, 3 or 4 layers are particularly recommended. The layer thicknesses of the individual layers differ from material to material, preferably by at most 5%.

Conventional (rotationally symmetrical) Goebel mirrors according to prior art are described e.g. in DE 198 33 524 A1 the entire disclosure of which is hereby incorporated by reference.

We claim:

1. A method for manufacturing a reflector for X-ray ray radiation having a curved substrate and a multi-layer coating deposited on the substrate, the method comprising the steps of:

a) determining a first non-circular arc shape for the substrate along a first cross-section, extending in an XZ plane containing an X direction;

b) determining, following step a), a d-value dependence that satisfies Bragg's condition in the X direction;

c) determining, in a YZ plane containing a Y direction perpendicular to the X direction, a deviation from a uniform coating dependence that results from a method of deposition of the coating, for a circular substrate shape in the YZ plane;

d) determining a second non-circular arc shape for the substrate along a second cross section, extending in the Y direction to compensate for the deviation determined in step c) by bringing regions of the reflector where coating deviations in the Y direction occur into Bragg reflection for a desired wavelength; and e) producing the reflector following steps a) to d), wherein the mirror focuses, renders parallel, or otherwise optically aligns the X-ray radiation in both the X and Y directions using one single reflection.

2. The method of claim 1, wherein the second arc shape of the reflector along the second cross section defines focusing properties of the reflector.

3. The method of claim 2, wherein the focusing properties are within the YZ plane.

4. The method of claim 1, wherein the first arc shape is parabolic, hyperbolic, or elliptical along the first cross-section.

5. The method of claim 1, wherein the multi-layer coating comprises a periodically repeating sequence of layers of materials A, B, . . . with different refractive indices, wherein a sum $d=d_A+d_B+\ldots$ of thicknesses $d_A$, $d_B$. . . of successive layers of the materials A, B, . . . changes continuously along the X-direction.

6. The method of claim 5, wherein the sum changes monotonically.

7. The method of claim 6, wherein the sum changes along the second cross-section.

8. The method of claim 7, where the sum changes by more than 2%.

9. The method of claim 7, wherein a curvature of the reflector along the second cross-section compensates for a change in said sum d along the second cross-section by differing from a comparable reflector with a constant sum d and circular curvature along a respective second cross-section thereof for given focusing and reflectivity properties of the reflector.

10. A reflector produced by the method of claim 9, wherein said first non-circular arc shape differs from said second non-circular arc shape.

11. The method of claim 1, wherein the second arc shape has an elliptical curvature of different lengths of semi-axes along the second cross-section.

12. The method of claim 1, wherein the second arc shape has a parabolic curvature along the second cross section.

13. The method of claim 1, wherein the reflector has a reflecting surface width of more than 2 mm as measured perpendicular to the X-direction.

14. The method of claim 13, wherein the width is at least 4 mm.

15. An X-ray analysis device comprising an X-ray source, an X-ray detector, optical shaping and/or delimiting means and the reflector produced by the method of claim 1, wherein said first non-circular arc shape differs from said second non-circular arc shape.

16. The X-ray analysis device of claim 15, wherein X-ray radiation impinges on the reflector at an angle of less than 5° with respect to the X-direction.

17. The X-ray analysis device of claim 15, wherein a curvature of the reflector along the second cross-section is formed such that a reflectivity of the reflector is maximum for a wavelength of radiation generated by said X-ray source.

18. The X-ray analysis device of claim 15, wherein the reflector focuses X-ray radiation impinging thereon to a focal spot.

19. The X-ray analysis device of claim 18, wherein the focal spot is on a sample or on the X-ray detector.

20. The X-ray analysis device of claim 15, wherein the reflector generates parallel rays.

21. A reflector produced by the method of claim 1, wherein said first non-circular arc shape differs from said second non-circular arc shape.

* * * * *